US008229310B2

(12) United States Patent
Iwasaki et al.

(10) Patent No.: US 8,229,310 B2
(45) Date of Patent: Jul. 24, 2012

(54) IMAGE FORMING DEVICE INCLUDING COLOR PHOTOCONDUCTOR DRUMS, PHOTOCONDUCTOR DRUM DRIVE CONTROLLING METHOD FOR CONTROLLING COLOR PHOTOCONDUCTOR DRUMS, AND COMPUTER-READABLE RECORDING MEDIUM

(75) Inventors: Hiroyuki Iwasaki, Kanagawa (JP); Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 423 days.

(21) Appl. No.: 12/457,824

(22) Filed: Jun. 23, 2009

(65) Prior Publication Data

US 2010/0008689 A1 Jan. 14, 2010

(30) Foreign Application Priority Data

Jun. 23, 2008 (JP) ..... 2008-163542
Jun. 8, 2009 (JP) ..... 2009-137714

(51) Int. Cl.
*G03G 15/16* (2006.01)
*G03G 15/01* (2006.01)

(52) U.S. Cl. ..... 399/66; 399/39

(58) Field of Classification Search ..... 399/66, 399/39, 82, 167, 165, 228
See application file for complete search history.

(56) References Cited

U.S. PATENT DOCUMENTS 7,054,586 B2 5/2006 Kuroda
7,228,095 B2 6/2007 Kuroda
7,280,789 B2 10/2007 Iwasaki
2004/0197111 A1 10/2004 Kuroda
2005/0235652 A1 10/2005 Iwasaki
2006/0002745 A1 1/2006 Iwasaki
2006/0133862 A1 6/2006 Kuroda
2007/0059041 A1 3/2007 Iwasaki
2007/0292170 A1 * 12/2007 Yoshioka ..... 399/299
2008/0056741 A1 3/2008 Iwasaki

FOREIGN PATENT DOCUMENTS

JP 2006-139063 6/2006
JP 2006220825 A * 8/2006
JP 2009031599 A * 2/2009

OTHER PUBLICATIONS

English machine translation of JP 2006-220825.*
English machine translation of JP 2009-031599.*

* cited by examiner

*Primary Examiner* — David Gray
*Assistant Examiner* — Billy J Lactaoen
(74) *Attorney, Agent, or Firm* — Harness, Dickey & Pierce, P.L.C.

(57) ABSTRACT

An image forming device has a full-color image formation mode to form a color image using color photoconductor drums and a monochrome image formation mode to form a monochrome image using a photoconductor drum. In the image forming device, a driving unit drives rotation of an intermediate transfer belt or a transfer transport belt. A control unit changes rotational speeds of the color photoconductors in a transition from the full-color image formation mode to the monochrome image formation mode to make a torque to the driving unit in the full-color image formation mode equal to a torque to the driving unit in the monochrome image formation mode. A separator unit separates the color photoconductors from the intermediate transfer belt or the transfer transport belt after the rotational speeds of the color photoconductors are changed by the control unit.

10 Claims, 21 Drawing Sheets

IMAGE FORMING DEVICE INCLUDING COLOR PHOTOCONDUCTOR DRUMS, PHOTOCONDUCTOR DRUM DRIVE CONTROLLING METHOD FOR CONTROLLING COLOR PHOTOCONDUCTOR DRUMS, AND COMPUTER-READABLE RECORDING MEDIUM

BACKGROUND OF THE INVENTION

1. Field of the Invention

This invention relates to an image forming device, such as a copier, a printer, a facsimile or a multi-function peripheral, which forms an image using a tandem type image formation unit, a photoconductor drum drive controlling method which is adapted to control driving of a photoconductor drum motor for the image forming device, and a computer-readable recording medium which is adapted to incorporate the photoconductor drum drive controlling method.

2. Description of the Related Art

Conventionally, among tandem type image forming devices, an indirect-transfer tandem type image forming device and a direct-transfer tandem type image forming device are known.

In the indirect-transfer tandem type image forming device, toner images of yellow, cyan, magenta, and black are formed on respective photoconductor drums, and these images are primarily transferred to an intermediate transfer belt (which is an intermediate transfer body), so that a full color image is formed by superimposing the images of the four colors on the intermediate transfer belt. The full color image formed on the intermediate transfer belt is secondarily transferred to a printing sheet, thereby forming the full color image on the printing sheet.

On the other hand, in the direct-transfer tandem type image forming device, each of toner images of four colors is respectively formed on one of the photoconductor drums and these images are superimposed on a printing sheet which is attracted and transported by a transfer transport belt, so that a full color image is formed on the printing sheet.

In order to ensure a long life of the photoconductor drums in these image forming devices, the color photoconductor drums are separated from the intermediate transfer belt or the transfer transport belt at the time of monochrome image formation. At the time of color image formation, the color photoconductor drums are contacted to the intermediate transfer belt or the transfer transport belt. Hence, the number of the photoconductor drums that are made in contact with the intermediate transfer belt or the transfer transport belt differs between at the time of monochrome image formation and at the time of color image formation. For this reason, the load on the intermediate transfer belt motor which drives the intermediate transfer belt (or the load on the transfer transport belt motor which drives the transfer transport belt) also differs between at the time of monochrome image formation and at the time of color image formation.

In order to ensure a high throughput when a color image and a monochrome image are output in a mixed manner, the imaging system motors in these image forming devices are continuously operated without stopping them during the mixed outputting of the color and monochrome images. In this case, the fluctuations of the load on the intermediate transfer belt motor or the transfer transport belt motor become large when the photoconductor drums are separated from the intermediate transfer belt (or the transfer transport belt) or when they are contacted to the intermediate transfer belt (or the transfer transport belt), and a certain time must be taken until the speed of the intermediate transfer belt motor (or the transfer transport belt motor) is stabilized. There is a possibility that the speed of the intermediate transfer belt motor (or the transfer transport belt motor) at this time is not stabilized and the intermediate transfer belt motor (or the transfer transport belt motor) falls out of control.

To avoid the problem, in the tandem type color image forming device according to the related art, the imaging system motor is temporarily stopped before the photoconductor drums are separated from or contacted to the intermediate transfer belt (or the transfer transport belt), and then the imaging system motor is restarted in order to prevent the intermediate transfer belt motor (or the transfer transport belt motor) from falling out of control due to the load fluctuation.

Moreover, Japanese Laid-Open Patent Publication No. 2006-139063 discloses an image forming device provided with a rotation fluctuation preventing unit. The rotation fluctuation preventing unit is arranged to prevent the fluctuation of rotation of the belt-like member due to movement of the color photoconductor drums at a start of monochrome image formation in which the black photoconductor drum is contacted to the belt-like member and the color photoconductor drums are moved away from the belt-like member.

However, in the above-described tandem type color image forming device according to the related art, the load torque to the intermediate transfer belt motor (or the load torque to the transfer transport belt motor) differs between at a time of full-color image formation and at a time of monochrome image formation. Hence, it is difficult for the tandem type color image forming device according to the related art to stabilize the rotation of the motor which drives the intermediate transfer belt (or the transfer transport belt), for example, in a transition from full-color image formation to monochrome image formation.

In the image forming device of Japanese Laid-Open Patent Publication No. 2006-139063, the load on the belt-like member is controlled using the rotation fluctuation preventing unit. However, it is difficult to prevent the fluctuation of the load arising when the inertial load is connected, and the resulting fluctuation may cause deterioration of a reproduced image.

SUMMARY OF THE INVENTION

In one aspect of the invention, the present disclosure provides an improved image forming device in which the above-described problems are eliminated.

In one aspect of the invention, the present disclosure provides an image forming device which is able to prevent rapid fluctuation of the load torque to the intermediate transfer belt motor or the transfer transport belt motor arising in a transition from the full-color image formation mode to the monochrome image formation mode or vice versa, thereby avoiding deterioration of a reproduced image.

In an embodiment of the invention which solves or reduces one or more of the above-mentioned problems, the present disclosure provides an image forming device provided with a full-color image formation mode to form a color image using a plurality of color photoconductor drums and a monochrome image formation mode to form a monochrome image using a single photoconductor drum, the image forming device including: a driving unit to drive rotation of an intermediate transfer belt or a transfer transport belt; a control unit to change rotational speeds of the plurality of color photoconductors in a transition from the full-color image formation mode to the monochrome image formation mode to make a torque to the driving unit in the full-color image formation mode equal to a torque to the driving unit in the monochrome image formation mode; and a separator unit to separate the plurality of color photoconductors from the intermediate transfer belt or the transfer transport belt after the rotational speeds of the plurality of color photoconductors are changed by the control unit.

In an embodiment of the invention which solves or reduces one or more of the above-mentioned problems, the present disclosure provides a photoconductor drum drive controlling method for an image forming device provided with a full-color image formation mode to form a color image using a plurality of color photoconductor drums and a monochrome image formation mode to form a monochrome image using a single photoconductor drum, the image forming device including a driving unit to drive rotation of an intermediate transfer belt or a transfer transport belt, the photoconductor drum drive controlling method including: changing, by a control unit of the image forming device, rotational speeds of the plurality of color photoconductors in a transition from the full-color image formation mode to the monochrome image formation mode to make a torque to the driving unit in the full-color image formation mode equal to a torque to the driving unit in the monochrome image formation mode; and separating, by a separator unit of the image forming device, the plurality of color photoconductors from the intermediate transfer belt or the transfer transport belt after the rotational speeds of the plurality of color photoconductors are changed by the control unit.

In an embodiment of the invention which solves or reduces one or more of the above-mentioned problems, the present disclosure provides a computer-readable recording medium storing a photoconductor drum drive controlling program which, when executed by a computer, causes the computer to perform the above-described photoconductor drum drive controlling method.

Other objects, features and advantages of the present invention will be more apparent from the following detailed description when read in conjunction with the accompanying drawings.

DETAILED DESCRIPTION OF THE PREFERRED EMBODIMENTS

Figure 1:
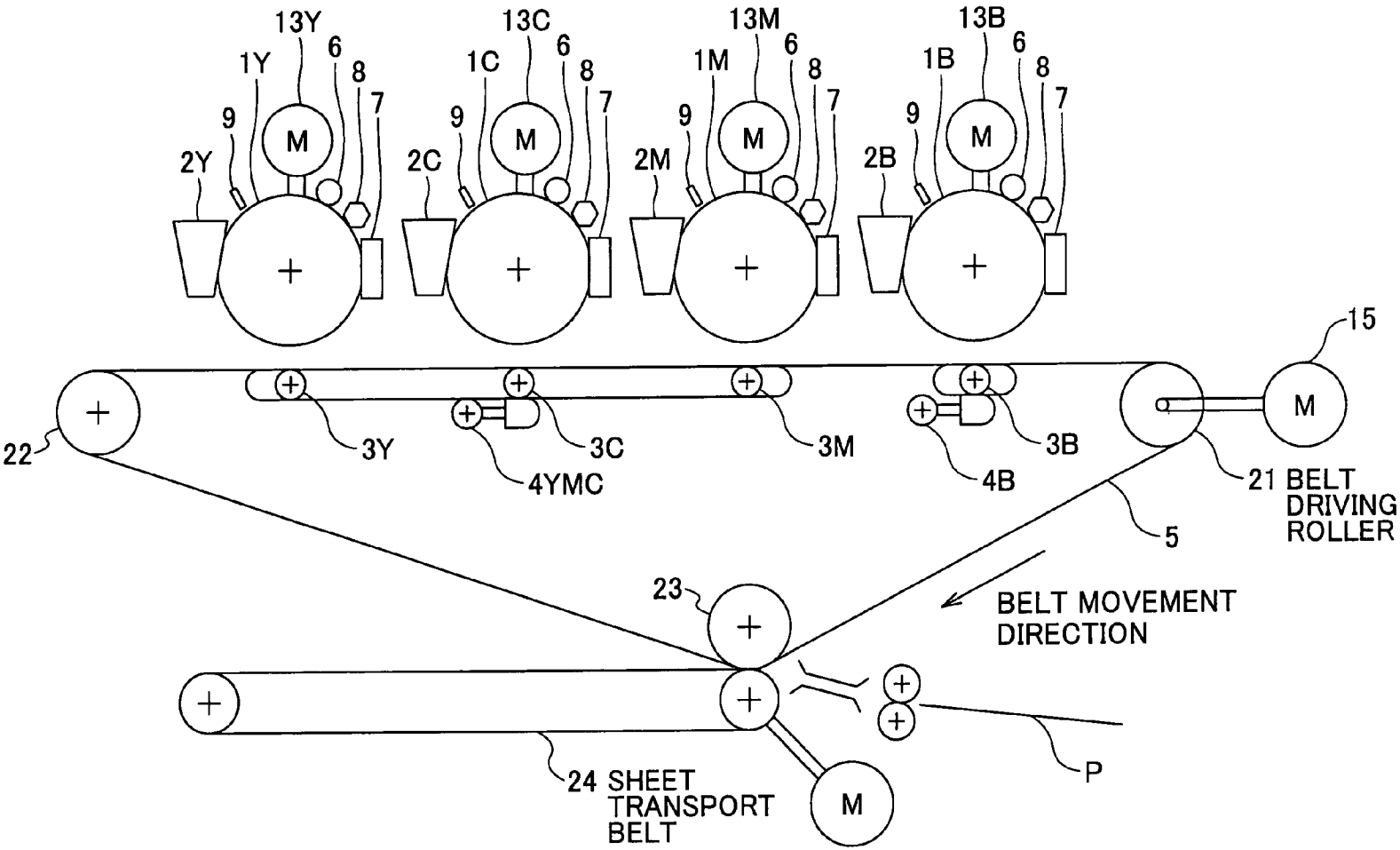
FIG. 1 is a diagram illustrating the composition of an imaging system in an indirect-transfer tandem type image forming device to which an embodiment of the invention is applied.

A description will be given of embodiments of the invention with reference to the accompanying drawings.

In the following embodiments, the element 1 (1Y, 1C, 1M, 1B) corresponds to a photoconductor drum, a main CPU 110 corresponds to a control unit, a separator motor 16 corresponds to a separator unit, a predriver 220*a* corresponds to an instruction torque value detecting unit, a current sensing resistor 40 corresponds to a current detecting unit, an intermediate transfer belt motor 15 or a transport belt motor 31 corresponds to a driving unit, the element 5 corresponds to an intermediate transfer belt, the element 30 corresponds to a transfer transport belt, and a printing sheet P corresponds to an image printing medium, respectively.

FIG. 1 is a diagram illustrating the composition of an imaging system in an indirect transfer tandem type image forming device to which an embodiment of the invention is applied.

As illustrated in FIG. 1, an imaging station for forming an image of each color of Y (yellow), C (cyan), M (magenta), and B (black) is arranged in the image forming device of this embodiment. Each of the four imaging stations includes a photoconductor drum 1, and arranged along the periphery of the photoconductor drum 1 are a developing device 2, a transferring device 3, a charging device 6, a cleaning device 7, a charge eliminating device 8, and a laser writing unit 9. The respective imaging stations of colors of Y, C, M and B are arranged side by side in this order of the colors in a direction of movement of an intermediate transfer belt 5.

In the composition of FIG. 1, the subscript letters Y, C, M and B are respectively attached to the reference numerals of the photoconductor drums 1, the developing devices 2, the transferring devices 3, the charging devices 6, the cleaning devices 7 and the charge eliminating devices 8 of the four colors, for the purpose of identifying a specific color. In the following, when referring to the element common to all the four colors collectively, the subscript letter attached to the reference numeral thereof will be omitted.

In the indirect transfer tandem type image forming device of FIG. 1, monochromatic toner images are formed on the photoconductor drums 1 respectively, the toner images on the photoconductor drums 1 are sequentially contacted and transferred to the intermediate transfer belt 5, so that the toner images are superimposed on the intermediate transfer belt 5 to form a full color image.

The intermediate transfer belt 5 is stretched between a driving roller 21, a first follower roller 22, and a second follower roller 23. The driving roller 21 is rotated by an intermediate transfer belt motor 15. Moreover, a sheet transport belt 24 is stretched between a driving roller and a follower roller. When a printing sheet P (which is an image printing medium) is transported to the nip between the intermediate transfer belt 5 and the sheet transport belt 24, the color image formed on the intermediate transfer belt 5 is transferred to the printing sheet P. The printing sheet P is transported to a fixing device (which is not illustrated), and after the color image is fixed to the printing sheet P, and the printing sheet is ejected to the outside of the image forming.

When the toner images on the photoconductor drums 1 are transferred to the intermediate transfer belt 5 in the indirect transfer tandem type image forming device, each of the transferring devices (transfer rollers) 3Y, 3C, 3M and 3B is moved up or down at a corresponding one of the transfer positions, if needed. When a color separator mechanism 4YMC and a black separator mechanism 4B operate to drive the transferring devices 3, the transferring devices 3 are moved up or down by the separator mechanisms 4YMC and 4B, which enables the photoconductor drum 1 and the intermediate transfer belt 5 to be contacted together or separated from each other.

A laser beam from the laser writing unit 9 of each color which is modulated in accordance with an image signal is emitted to and scanned over one of the photoconductor drums 1, so that a latent image of each color is formed on each photoconductor drum 1.

Figure 2:
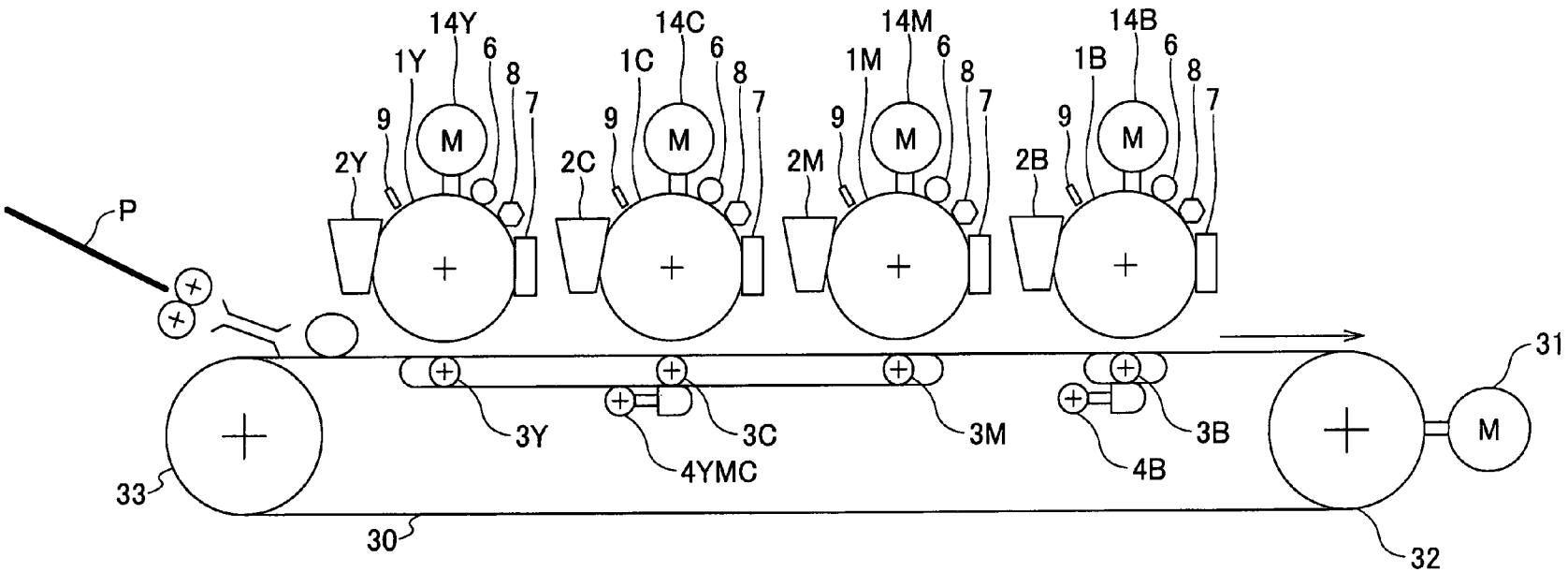
FIG. 2 is a diagram illustrating the composition of an imaging system in a direct-transfer tandem type image forming device to which an embodiment of the invention is applied.

FIG. 2 is a diagram illustrating the composition of an imaging system in a direct-transfer tandem type image forming device to which an embodiment of the invention is applied.

In FIG. 2, the elements which are the same as corresponding elements in the indirect transfer tandem type image forming device illustrated in FIG. 1 are designated by the same reference numerals, and a duplicate description thereof will be omitted.

In the direct transfer tandem type image forming device of FIG. 2, toner images of four different colors are respectively formed by the four imaging stations, similar to those in the indirect transfer tandem type image forming device of FIG. 1. Each of the toner images of the respective colors formed by the imaging stations is transferred to a printing sheet P which is attracted and transported by a transfer transport belt 30. Consequently, a full color image is formed on the printing sheet P.

At a transfer position of each of the imaging stations, each of the transferring devices (transfer rollers) 3Y, 3C, 3M and 3B is moved up or down, if needed. When the separator mechanisms 4YCM and 4B operate to drive the transferring devices 3, the transferring devices 3 are moved up or down by the separator mechanisms 4YCM and 4B, which enables the photoconductor drum 1 and the transfer transport belt 30 to be contacted together or separated from each other.

In the composition of FIG. 2, the element 14 is a photoconductor drum motor. The photoconductor drum motor 14 corresponds to the photoconductor drum motor 13 in the indirect transfer tandem type image forming device.

A transfer transport belt 30 is stretched between a driving roller 32 and a follower roller 33. The driving roller 32 is rotated by a transport belt motor 31, and the transfer transport belt 30 is moved and rotated in the direction indicated by the arrow in FIG. 2.

Operation of the image formation of the tandem type image forming devices illustrated in FIG. 1 and FIG. 2 is essentially the same as that of a known image forming device, and a description thereof will be omitted because it is not directly related to the invention.

Figure 3:
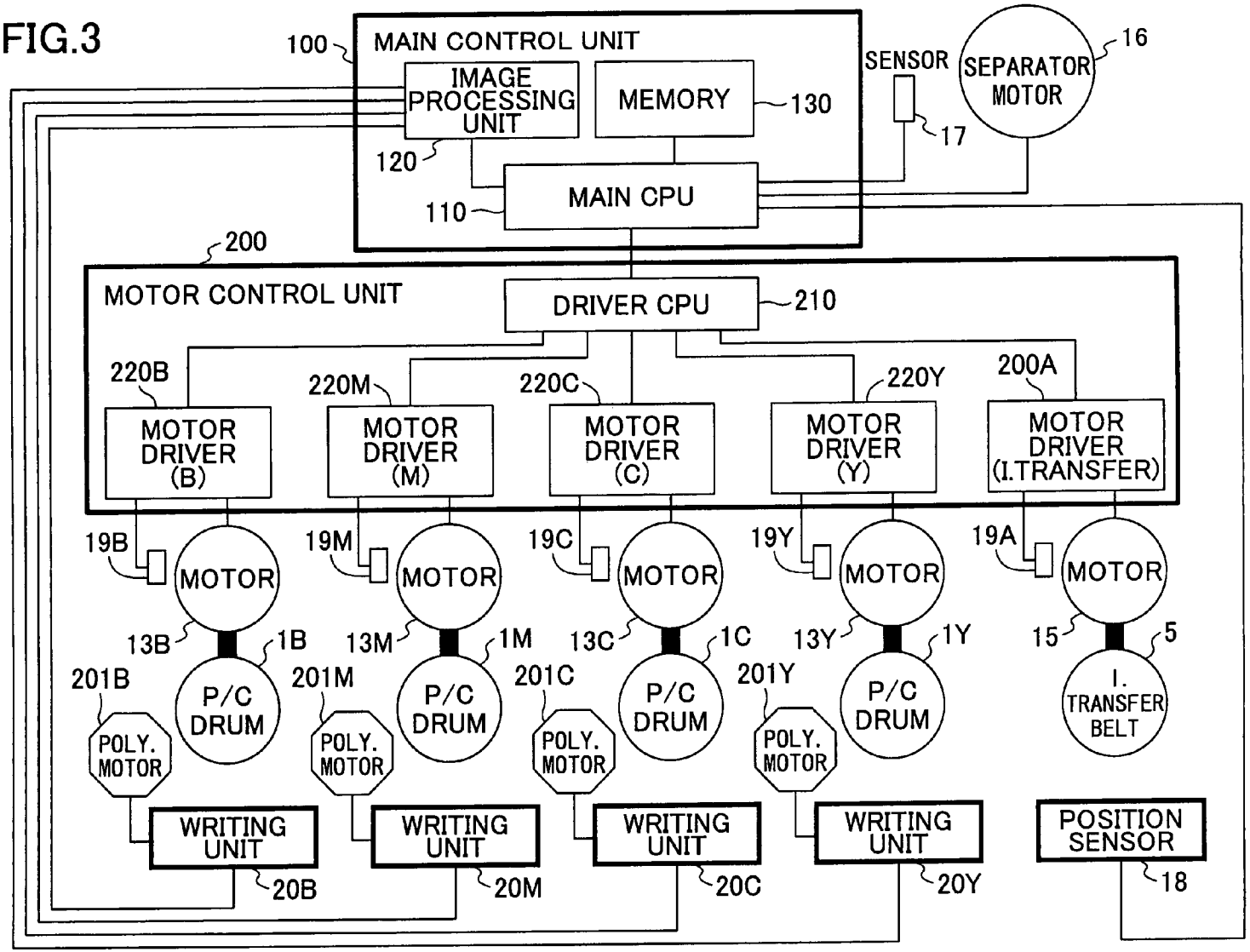
FIG. 3 is a block diagram illustrating the composition of a main control unit and a motor control unit for controlling driving units of image-formation related motors in a tandem type image forming device to which an embodiment of the invention is applied.

FIG. 3 is a block diagram illustrating the composition of a main control unit and a motor control unit for controlling driving units of image formation related motors in a tandem type image forming device to which an embodiment of the invention is applied.

As illustrated in FIG. 3, the image forming device includes a main control unit 100 and a motor control unit 200. The main control unit 100 includes a main CPU 110, an image processing unit 120, and a memory 130. The main control unit 100 controls the image formation to process image data. The main control unit 100 controls the motors through the motor control unit 200. The memory 130 constitutes a computer-readable recording medium of an embodiment of the invention which stores a photoconductor drum drive controlling program which, when executed by a computer, causes the computer to perform a photoconductor drum drive controlling method of the invention.

Based on image information, such as image data related to the image formation, the main CPU 110 controls the driving loads of the motors. Specifically, the main CPU 110 controls the separator motor 16 which drives the separator mechanisms 4YCM and 4B of the transferring devices 3. For example, the main CPU 110 determines whether the following image formation is full-color image formation or monochrome image formation, and controls the contacting or separation of the color separator mechanism 4 (separator mechanism 4YCM) using the separator motor 16. Reference numeral 17 denotes a position sensor which detects the position of the separator mechanism 4 of the transferring device 3.

The main CPU 110 outputs a driving control signal of the intermediate transfer belt motor 15 to a driver CPU 210 based on the position information from a position sensor 18 which detects the position of the intermediate transfer belt 5.

In a case in which the surface speed of the color photoconductor drum 1 is smaller than the surface speed of the intermediate transfer belt 5, when it is detected that the following image formation is monochrome image formation, the main CPU 110 increases, in a transition from full-color image formation to monochrome image formation, the rotational speed of the color photoconductor drum 1, so that the torque to the intermediate transfer belt motor 15 to drive the intermediate transfer belt 5 at the time of full-color image formation is made equal to the torque to the intermediate transfer belt motor 15 at the time of monochrome image formation.

In a case in which the surface speed of the color photoconductor drum 1 is larger than the surface speed of the intermediate transfer belt 5, when it is detected that the following image formation is monochrome image formation, the main CPU 110 decreases, in a transition from full-color image formation to monochrome image formation, the rotational speed of the color photoconductor drum 1 so that the torque to the intermediate transfer belt motor 15 to drive the intermediate transfer belt 5 at the time of full-color image formation is made equal to the torque to the intermediate transfer belt motor 15 at the time of monochrome image formation.

After the rotational speed is changed, the main CPU 110 causes the color photoconductor drum 1 to be separated from the intermediate transfer belt 15 using the separator motor 16 which drives the separator mechanism 4 of the transferring device 3. A detailed control procedure of the main CPU 110 will be described later.

The image processing unit 120 outputs to the main CPU 110 and the writing unit 20 an image frame signal which indicates a start and an end of an image region of each color in accordance with the image data. The writing unit 20 emits a laser beam to a polygon mirror (which is rotated at a high speed by a polygon motor 201) in accordance with the image data received from the image processing unit 120, in order to form an electrostatic latent image on the photoconductor drum 1.

The motor control unit 200 includes a driver CPU 210 and a motor drivers (motor drivers) 220 (220B, 220M, 220C, 220Y, 220A). In accordance to the instructions received from the main control unit 100, the motor control unit 200 determines the rotational speed of the photoconductor drum motor 13 to drive the photoconductor drum 1 of each imaging station and the rotational speed of the intermediate transfer belt motor 15 to drive the intermediate transfer belt 5, and performs control of the rotation and driving of the photoconductor drum motor 13 and the intermediate transfer belt motor 15.

The driver CPU 210 is connected to the main CPU 110 and receives instructions from the main CPU 110. The driver CPU 210 performs start and stop control of the motors 13 (13B, 13C, 13M, 13Y) to drive the respective photoconductor drums 1 (1B, 1M, 1C, 1Y) and the intermediate transfer belt motor 15, and rotational speed control of the respective motors 13 and 15.

The motor drivers 220 perform drive control of the respective motors in accordance with the respective signals from the encoders 19 (19B, 19M, 19C, 19Y, 19A) which are attached to the photoconductor drum motors 13 and the intermediate transfer belt motor 15.

Figure 4:
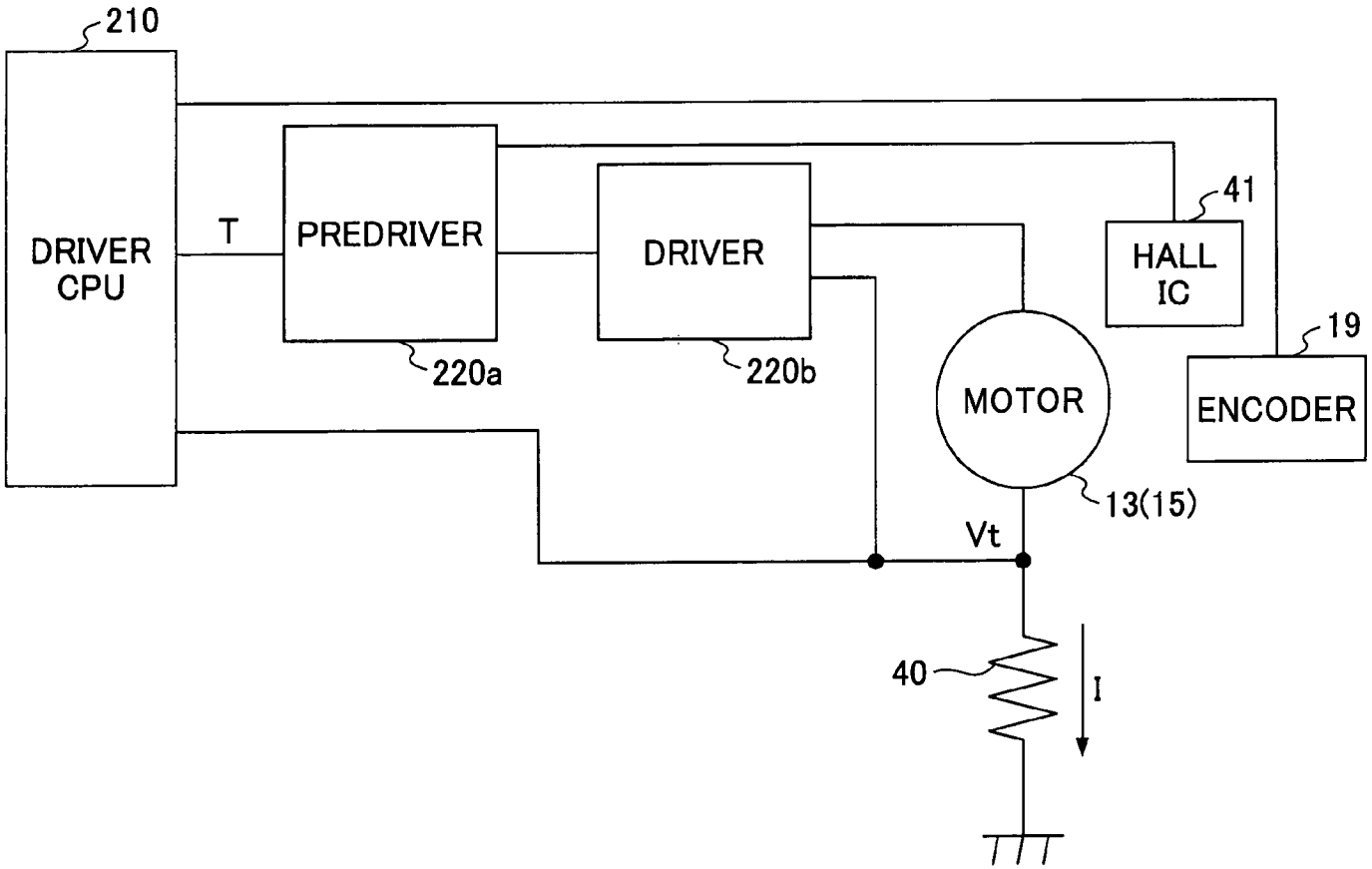
FIG. 4 is a block diagram illustrating the composition of a motor control unit in the image forming device illustrated in FIG. 3.

FIG. 4 is a diagram illustrating the control composition of a motor control unit in the image forming device illustrated in FIG. 3. In this embodiment, a three-phase motor is used, and the composition of a motor control unit to control a three-phase motor is illustrated in FIG. 4.

As illustrated in FIG. 4, the motor control unit of this embodiment includes a driver CPU 210, a predriver 220*a* with an input connected to an output of the driver CPU 210, and a driver 220*b* with an input connected to an output of the predriver 220*a*. The predriver 220*a* and the driver 220*b* in this embodiment constitute a motor driver 220.

As illustrated in FIG. 4, the driver CPU 210 monitors the rotational speed of each of the photoconductor drum motor 13 and the intermediate transfer belt motor 15 using the output signal of the encoder 19. The driver CPU 210 converts into a voltage Vt a detected current I of the motor 13 or 15 which flows through a current sensing resistor 40 connected to the motor 13 or 15, and monitors the resulting voltage Vt.

The driver CPU 210 outputs an instruction torque value T to the predriver 220*a* based on the monitored rotational speed of the motor 13 or 15. The instruction torque value T may be an analog value or PWM (Pulse Width Modulation) value.

The predriver 220*a* controls the amplitude of the current which flows through each of the photoconductor drum motor 13 and the intermediate transfer belt motor 15, based on the instruction torque value T from the driver CPU 210. The predriver 220*a* is connected to a hall IC 41 and selects the phase energized from the rotor position of the photoconductor drum motor 13 or the intermediate transfer belt motor 15.

The driver 220*b* may be constructed by an FET (Field Effect Transistor) or another transistor. The driver 220*b* performs amplitude conversion of the signal of each phase from the predriver 220*a*, and drives the photoconductor drum motor 13 or the intermediate transfer belt motor 15.

Next, the difference between the surface speed of the photoconductor drum 1 and the surface speed of the intermediate transfer belt 5 will be described. It is known in the art that the larger the difference between the surface speed of the photoconductor drum 1 and the surface speed of the intermediate transfer belt 5, the better the transferring efficiency in transferring the toner image formed on the photoconductor drum 1 to the intermediate transfer belt 5. For this reason, the image forming device is usually arranged to have a certain difference between the surface speed of the photoconductor drum 1 and the surface speed of the intermediate transfer belt 5.

First, an image forming device of a first embodiment of the invention is adapted for a case in which the surface speed of the photoconductor drum 1 is smaller than the surface speed of the intermediate transfer belt 5.

Figure 5:
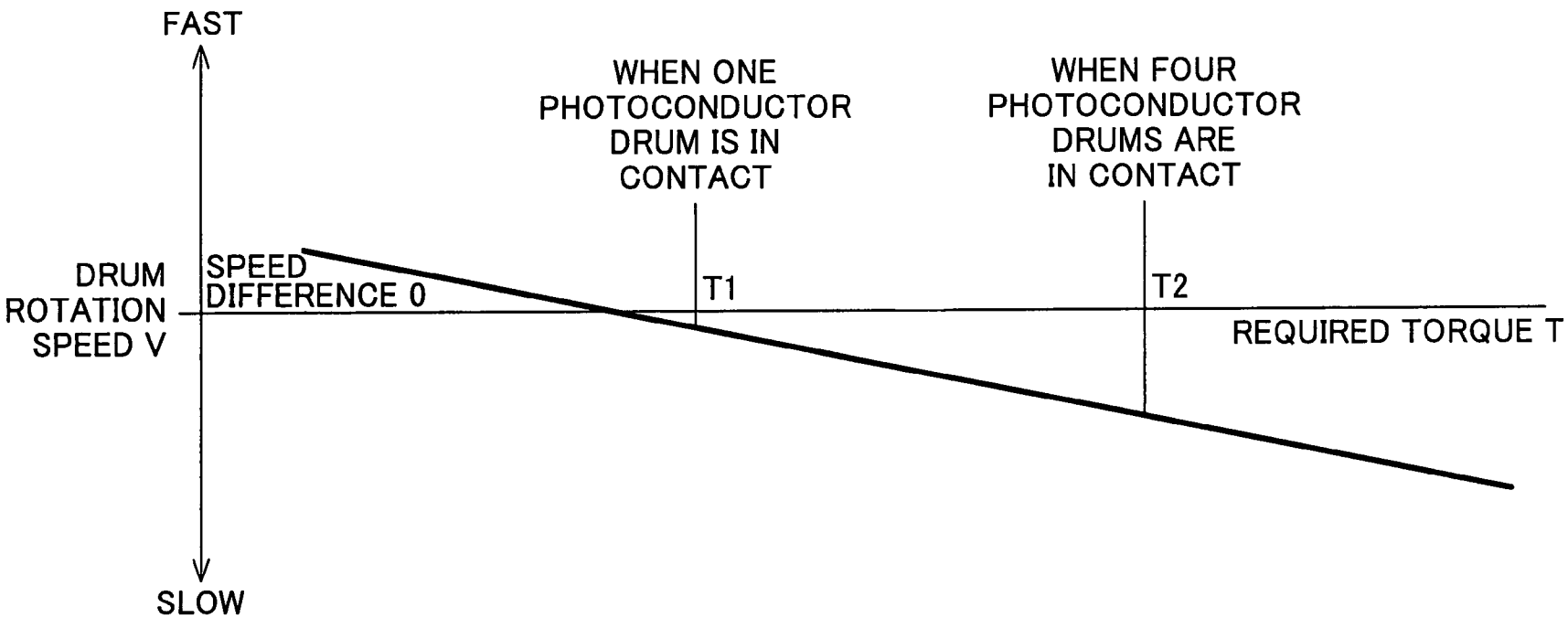
FIG. 5 is a diagram for explaining the relationship between the rotational speed of a photoconductor drum motor and the required torque of an intermediate transfer belt motor when the surface speed of a photoconductor drum is smaller than the surface speed of an intermediate transfer belt.

FIG. 5 is a diagram for explaining the relationship between the rotational speed V of a photoconductor drum motor and the required torque T of an intermediate transfer belt motor when the surface speed of a photoconductor drum is smaller than the surface speed of an intermediate transfer belt.

The horizontal line of "speed difference 0" in FIG. 5 indicates that the difference between the surface speed of the photoconductor drum 1 and the surface speed of the intermediate transfer belt 5 on this horizontal line is equal to 0.

As illustrated in FIG. 5, if the rotational speed of the photoconductor drum motor 13 is small and the difference between the surface speed of the photoconductor drum 1 and the surface speed of the intermediate transfer belt 5 becomes negative, the load on the intermediate transfer belt motor 15 by dynamic friction resistance becomes large. For this reason, the required torque of the intermediate transfer belt motor 15 in such a case becomes large.

If the rotational speed of the photoconductor drum motor 13 is large and the difference between the surface speed of the photoconductor drum 1 and the surface speed of the intermediate transfer belt 5 becomes positive, the load on the intermediate transfer belt motor 15 by dynamic friction resistance becomes small. For this reason, the required torque of the intermediate transfer belt motor 15 in such a case becomes small.

There are the four photoconductor drums 1 of B, C, M and Y in the image forming device. Even if the rotational speeds of the photoconductor drums 1 are the same, the load on the intermediate transfer belt motor 15 differs between at the time of the four photoconductor drums 1 contacting the intermediate transfer belt 5 and at the time of one photoconductor drum 1 contacting the intermediate transfer belt 5.

Hence, the image forming device of the first embodiment is arranged to change the rotational speed of the photoconductor drum motor 13 in order to eliminate the load fluctuation in a transition from the time of the four photoconductor drums 1 contacting the intermediate transfer belt 5 to the time of one photoconductor drum 1 contacting the intermediate transfer belt 5 or vice versa.

In the first embodiment, the circumferential speeds (rotational speeds) of the color photoconductor drums 1Y, 1C and 1M are changed in a transition from full-color image formation to monochrome image formation, in order to smoothly change the required torque T2 of the intermediate transfer belt motor 15 when the four photoconductor drums 1Y, 1C, 1M and 1B contact the intermediate transfer belt 5 to form a full-color image to the required torque T1 when only the photoconductor drum 1B contacts the intermediate transfer belt 5 to form a monochrome image.

Specifically, in a case of the surface speed of the photoconductor drum 1 being smaller than the surface speed of the intermediate transfer belt 5, the rotational speeds of the color photoconductor drums 1Y, 1C and 1M are increased in a transition from the full-color image formation mode to the monochrome image formation mode to make the required torque of the intermediate transfer belt motor 15 to drive the intermediate transfer belt 5 equal to the required torque T1 of the intermediate transfer belt motor 15 in the monochrome image formation mode.

In other words, the surface speeds of the color photoconductor drums 1Y, 1C and 1M are changed so as to approach the surface speed of the intermediate transfer belt at the time of monochrome image formation. Thereby, the required torque of the intermediate transfer belt motor 15 to drive the intermediate transfer belt at a start of monochrome image formation can approach the required torque T1 of the intermediate transfer belt motor 15 when only the photoconductor drum 1B contacts the intermediate transfer belt.

Figure 6:
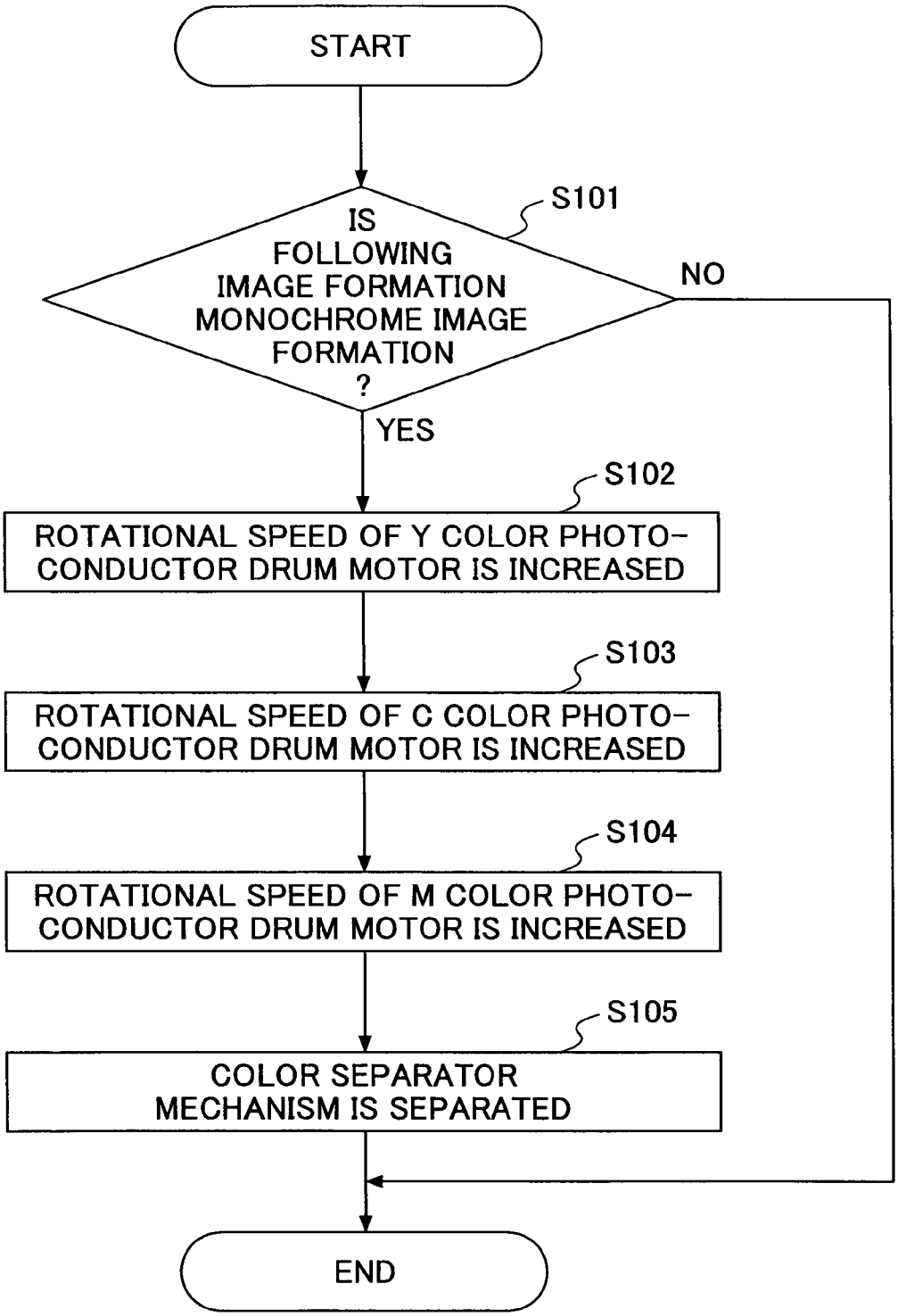
FIG. 6 is a flowchart for explaining a control procedure in a transition from full-color image formation to monochrome image formation in a case of the surface speed of a photoconductor drum being smaller than the surface speed of an intermediate transfer belt.

FIG. 6 is a flowchart for explaining a control procedure in a transition from full-color image formation to monochrome image formation in a case of the surface speed of a photoconductor drum being smaller than the surface speed of an intermediate transfer belt.

The control procedures as illustrated in FIGS. 6-12 are performed by the main CPU 110 after the program stored in the memory 130 or the ROM (which is not illustrated) is read and loaded to the RAM used as a work area (which is not illustrated).

As illustrated in FIG. 6, if it is detected by the main CPU 110 at the time of full-color image formation that the following image formation is monochrome image formation (YES in step S101), the rotational speeds of the photoconductor drum motors 13 are increased by dV sequentially from the Y color photoconductor drum motor 13Y which is located at the upstream side location in the direction of the belt movement.

Specifically, the speed Vy of the photoconductor drum motor 13Y of Y color is first increased by dV (step S102). And after the time td has elapsed, the speed Vc of the photoconductor drum motor 13C of C color is increased by dV (step S103). And after the time td has further elapsed, the speed Vm of the photoconductor drum motor 13M of M color is increased by dV (step S104) as in the timing chart of FIG. 7 which will be given below.

Then, the separator motor 16 is driven to cause the separator mechanism 4 of the transferring device 3 to separate the intermediate transfer belt 5 (or transfer transport belt 30) from the photoconductor drum 1 (step S105), so that the photoconductor drum 1 and the intermediate transfer belt 5 are separated from each other.

In the above-described procedure, when the main CPU 110 determines that the following image formation is not monochrome image formation (NO in step S101), the control procedure is terminated.

In this embodiment, the value of the above-mentioned speed dV and the value of the time td are determined depending on the characteristics of the torque of the intermediate transfer belt motor 15, and the speed of the photoconductor drum motor 13. These values are set up as product-specific values at the time of shipment of the products or the time of maintenance of the photoconductor drum 1 or the intermediate transfer mechanism.

In this embodiment, the increasing of the rotational speeds of the photoconductor drum motors 13 is performed sequentially from that of the photoconductor drum 1 located on the upstream side in the direction of movement of the intermediate transfer belt 5.

Because the color photoconductor drums 1 in the image forming device of this embodiment are arranged in order of Y, C and M, the increasing of the motor speeds is performed in this order. Therefore, if the order of the arrangement of the color photoconductor drums 1 of the imaging stations differs that of this embodiment, then the order of the increasing of the motor speeds is to be changed in accordance with that order of the arrangement.

In the procedure of FIG. 6, the speeds of the photoconductor drum motors 13Y, 13C and 13M of Y, C and M color are changed. Alternatively, only the speed of at least one of the photoconductor drum motors 13 may be changed.

Figure 7:
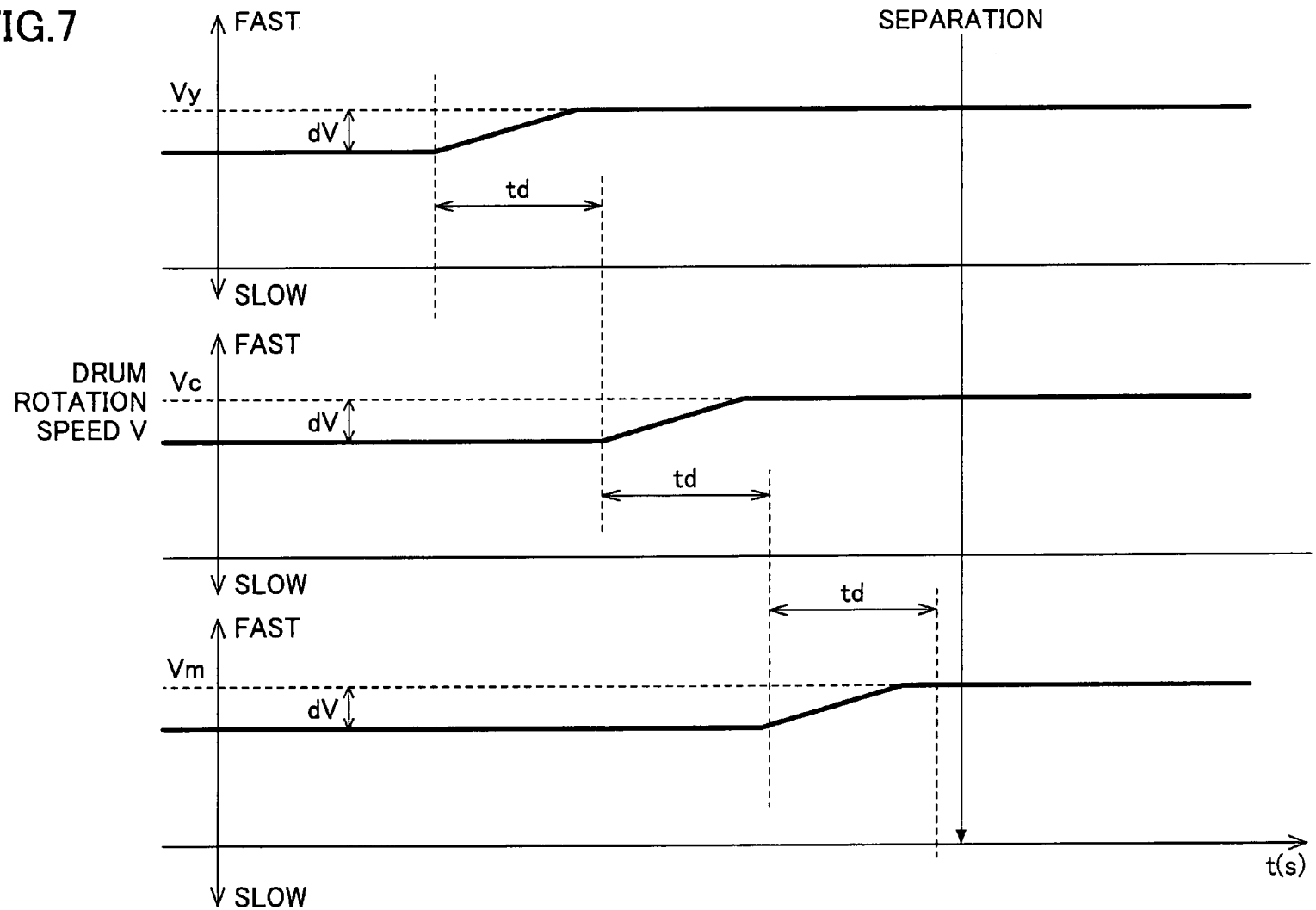
FIG. 7 is a timing chart for explaining the speed control of the color photoconductor drum motors in the control procedure of FIG. 6 and the timing of separation of the color separator mechanism from the intermediate transfer belt.

FIG. 7 is a timing chart for explaining the speed control of the color photoconductor drum motors in the control procedure of FIG. 6 and the timing of separation of the color separator mechanism from the intermediate transfer belt.

The timing chart of FIG. 7 corresponds to the speed control (increasing of the motor speeds) of the steps S102 to 104 and the separating action of the step S105 in the control procedure of FIG. 6.

In the timing chart of FIG. 7, the horizontal axis denotes the elapsed time t(s) and the vertical axis denotes the respective speeds Vy, Vc and Vm of the color photoconductor drum motors 13 of Y, C and M.

In the timing chart of FIG. 7, the speed of the photoconductor drum motor 13 is increased by dV in one step during the period of the time td. Alternatively, the motor speed may be gradually increased to a target speed in a number of steps during the period of the time td.

Figure 8:
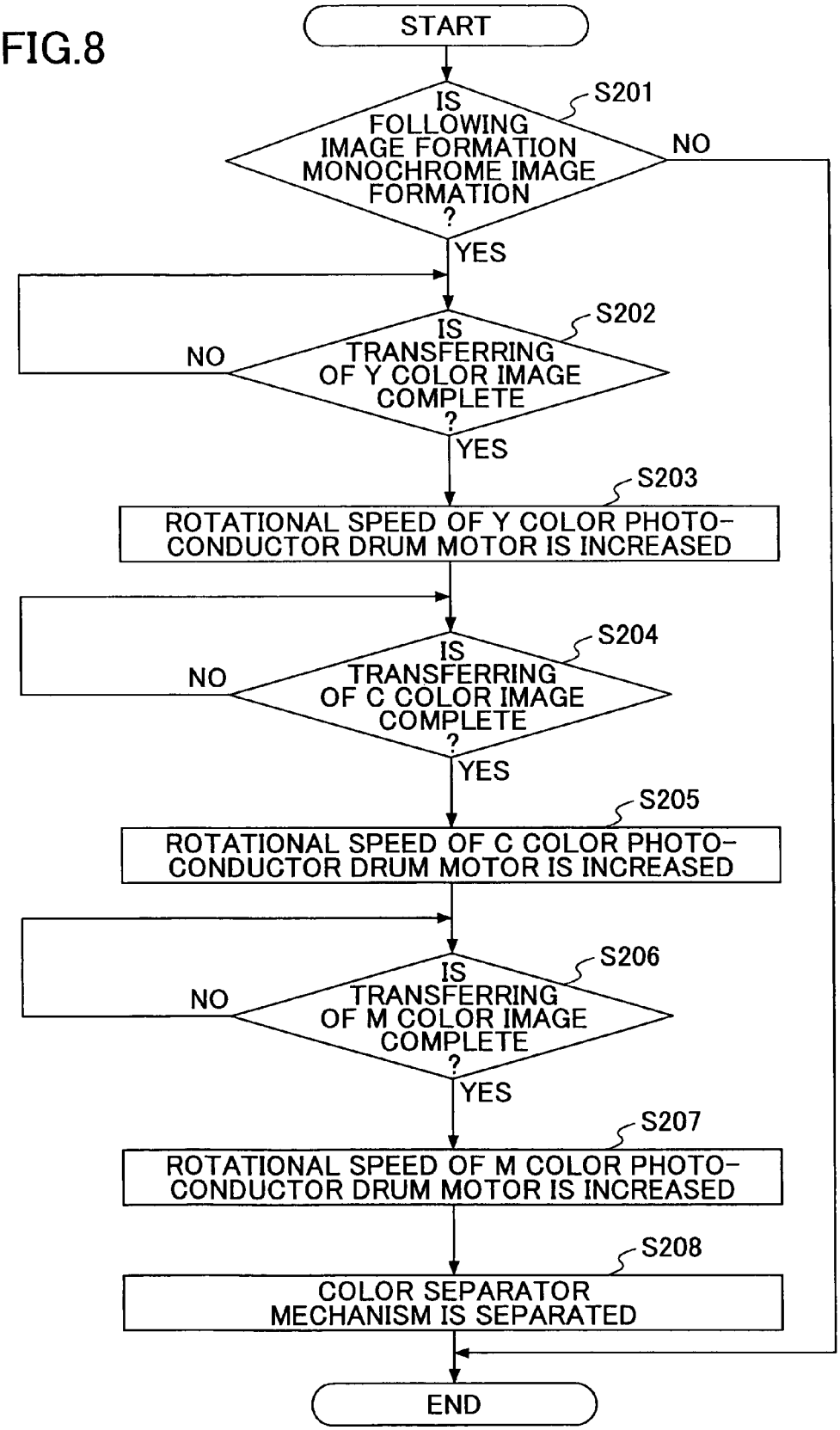
FIG. 8 is a flowchart for explaining a control procedure in which the rotational speeds of the photoconductor drum motors are increased sequentially from that of the photoconductor drum in which the transferring of an image is completed.

When changing from full-color image formation to monochrome image formation using FIG. 8, the control procedure into which speed is changed sequentially from the photoconductor drum motor which ended transfer during formation of a full-color image is explained.

FIG. 8 is a flowchart for explaining a control procedure in which the rotational speeds of the photoconductor drum motors are increased sequentially from that of the photoconductor drum in which the transferring of an image is completed.

As illustrated in FIG. 8, if it is detected by the main CPU 110 at the time of full-color image formation that the following image formation is monochrome image formation (YES in step S201), the next step S202 is performed. The Y image frame signal of the current image is used as a trigger, and after a Y color image is formed on the photoconductor drum 1Y and the transferring of the Y color image is completed at the transfer position (YES in step S202), the rotational speed of the photoconductor drum motor 13Y is increased by dV (step S203).

Similarly, the C image frame signal of the current image is used as a trigger, and after a C color image is formed on the photoconductor drum 1C and the transferring of the C color image is completed at the transfer position (YES in step S204), the rotational speed of the photoconductor drum motor 13C is increased by dV (step S205).

Similarly, the M image frame signal of the current image is used as a trigger, and after an M color image is formed on the photoconductor drum 1M and the transferring of the M color image is completed at the transfer position (YES in step S206), the rotational speed of the photoconductor drum motor 13M is increased by dV (step S207).

Then, the separator mechanism 4 of the transferring device 3 is caused to separate the intermediate transfer belt 5 from the photoconductor drum 1 (step S208), the control procedure is terminated, and the following monochrome image will be formed.

In the above-described procedure, when it is detected by the main CPU 110 that the following image formation is not monochrome image formation (NO in step S201), the control procedure is terminated.

In each of the above steps S202, S204 and S206, if the time for transferring the image of each color has not elapsed (NO in steps S202, S204, and S206), the procedure is continued until the time has elapsed.

The value of the above speed dV is set up as a value specific to the product at the time of maintenance of the photoconductor drum 1 or the intermediate transfer mechanism or at the time of shipment of the products.

In the above-mentioned procedure, when the increasing of the speed of the photoconductor drum motor 13M of M color is completed and the separation action of the color separator mechanism 4YCM is performed (step S208), only the monochrome separator mechanism 4B is contacted. At this time, the rotational speed of each photoconductor drum motor 13 is increased so as to avoid fluctuation of the driving torque to drive the intermediate transfer belt 5, or the driving torque of the intermediate transfer belt motor 15. Namely, the driving torque is made equal to the above torque T1 in FIG. 5.

In the flowchart of FIG. 8, the rotational speeds of the photoconductor drum motors 13Y, 13M and 13C of Y, C and M are increased. Alternatively, only the rotational speed of at least one of the photoconductor drum motors may be increased.

In the above-mentioned procedure, the image frame signal of the current image is used as a trigger and the rotational speed of each color photoconductor drum motor 13 is changed. Alternatively, the rotational speed of each color photoconductor drum motor 13 may be changed by using the completion of transferring of each color image to the intermediate transfer belt 5 as a trigger.

In the above-described method, the motor speeds are changed sequentially from the motor of the photoconductor drum in which the transferring of a color image is completed during formation of a full-color image. Hence, formation of a monochrome image can be started quickly from the end of full-color image formation.

Figure 9:
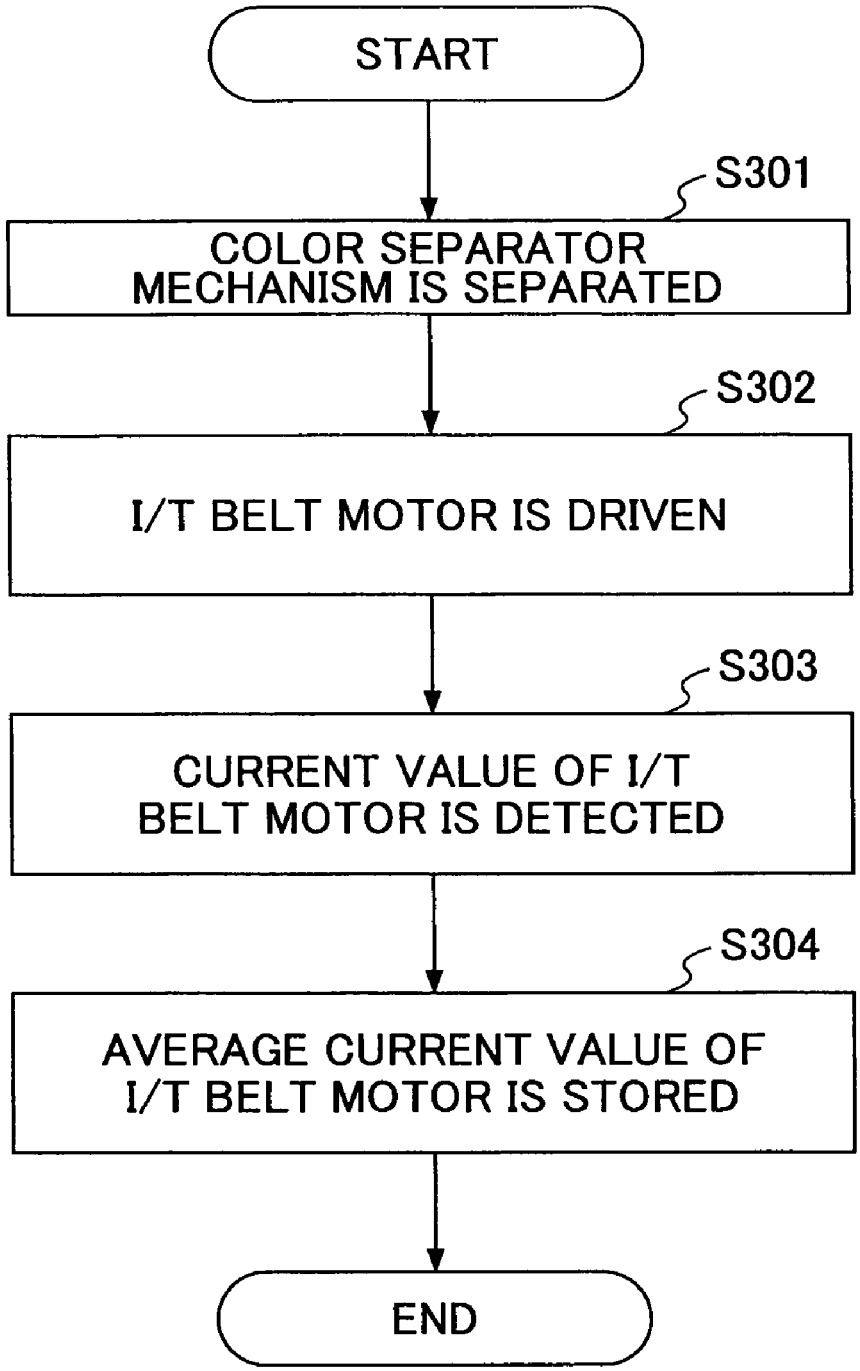
FIG. 9 is a flowchart for explaining a detection procedure which detects beforehand a motor current of the intermediate transfer belt motor at a time of monochrome image formation, to obtain a target current value of the intermediate transfer belt motor in a transition from full-color image formation to monochrome image formation.

FIG. 9 is a flowchart for explaining a detection procedure which detects beforehand a motor current of the intermediate transfer belt motor at a time of monochrome image formation, to obtain a target current value of the intermediate transfer belt motor in a transition from full-color image formation to monochrome image formation.

As illustrated in FIG. 9, the main CPU 110 causes the color separator mechanism 4 to separate the intermediate transfer belt 5 from the color photoconductor drums (step S301), and drives the intermediate transfer belt motor 15 (step S302).

The main CPU 110 monitors (measures) a current value of the intermediate transfer belt motor 15 during the step S302 (step S303), and stores the average current value of the intermediate transfer belt motor (step S304).

The main CPU 110 uses the average current value stored in the step S304, as a target current value of the intermediate transfer belt motor 15 in a transition from full-color image formation to monochrome image formation. The main CPU 110 uses the target current value when performing the control of varying the rotational speed of the photoconductor drum motor 13.

The detection procedure of FIG. 9 may be performed at a time the power switch is turned on or at a time the temperature inside the image forming device has changed by a certain amount.

Figure 10:
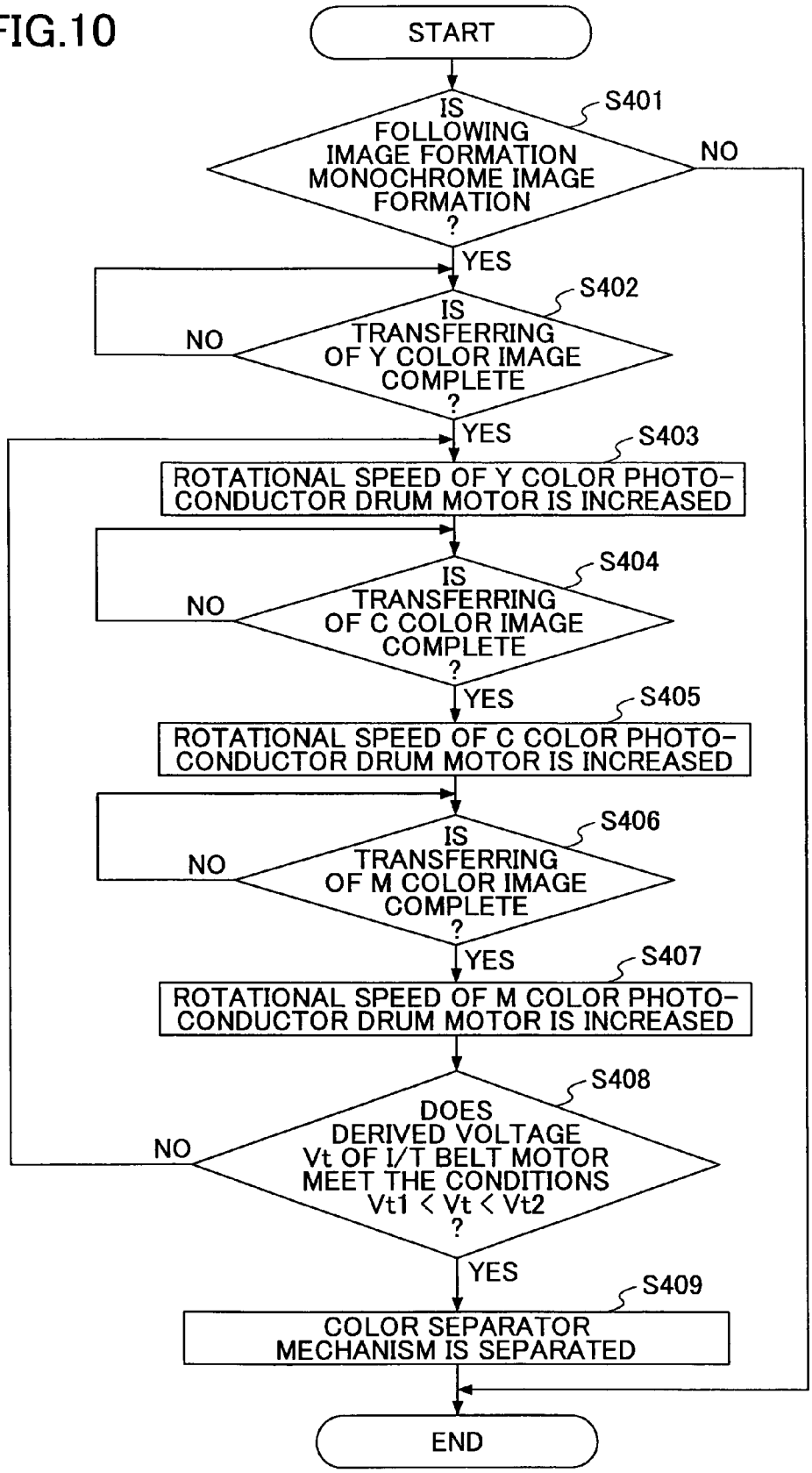
FIG. 10 is a flowchart for explaining a control procedure in which the speeds of the photoconductor drum motors are increased in a transition from full-color image formation to monochrome image formation based on a motor current value of the intermediate transfer belt motor at the time of monochrome image formation.

FIG. 10 is a flowchart for explaining a control procedure in which the speeds of the photoconductor drum motors are increased in a transition from full-color image formation to monochrome image formation based on a motor current value of the intermediate transfer belt motor monitored at the time of monochrome image formation.

As illustrated in FIG. 10, if it is detected by the main CPU 110 at the time of full-color image formation that the following image formation is monochrome image formation (Yes in step S401), the next step S402 is performed. The Y image frame signal of the current image is used as a trigger. After a Y color image is formed on the photoconductor drum 1Y and the transferring of the Y color image is completed at the transfer position (YES in step S402), the rotational speed of the photoconductor drum motor 13Y is increased by dV (step S403).

Similarly, the C image frame signal of the current image is used as a trigger. After a C color image is formed on the photoconductor drum 1C and the transferring of the C color image is completed at the transfer position (YES in step S404), the rotational speed of the photoconductor drum motor 13C is increased by dV (step S405).

Similarly, the M image frame signal of the current image is used as a trigger. After an M color image is formed on the photoconductor drum 1M and the transferring of the M color image is completed at the transfer position (YES in step S406), the rotational speed of the photoconductor drum motor 13M is increased by dV (step S407).

When the voltage Vt obtained by the voltage conversion of the motor current I of the intermediate transfer belt motor 15 does not meet the conditions Vt1<Vt<Vt2 (NO in step S408), the procedure of steps S403 to S407 is repeated and the rotational speeds of the Y, C, and M photoconductor drums are changed again.

When the conditions Vt1<Vt<Vt2 are met (YES in step S408), the intermediate transfer belt 5 is separated from the color photoconductor drum 1 by using the color separator mechanism 4YMC (step S409), the control procedure is terminated, and the following monochrome image will be formed.

In the control procedure of FIG. 10, when it is detected by the main CPU 110 that the following image formation is not monochrome image formation (NO in step S401), the control procedure is terminated. In each of the steps S402, S404 and S406, if the time for transferring the image of each color has not elapsed (NO in steps S402, S404, and S406), the procedure is continued until the transferring of the image is completed.

The values of Vt1 and Vt2 are set up beforehand to designate a target voltage range for the voltage Vt. If the voltage Vt falls within the range between Vt1 and Vt2, then it is determined at step S408 that the conditions are met.

If the voltage Vt falls within the range between Vt1 and Vt2, it can be considered that the torque of the intermediate transfer belt motor 15 at this time is equal to the torque of the intermediate transfer belt 15 in the monochrome image formation mode.

In this embodiment, the values of Vt1 and Vt2 may be set to arbitrary values. Specifically, the values of Vt1 and Vt2 may be set to be in the range of about ±5% of the voltage which is derived by the current-voltage conversion of the motor current value I of the intermediate transfer belt motor 15 at the time of monochrome image formation.

In the control procedure of FIG. 10, the speeds of the photoconductor drum motors 13 of Y, C and M are changed. Alternatively, the control procedure may be replaced by changing the speed of at least one of the photoconductor drum motors 13.

By the control procedure of this embodiment, it is possible to control the rotational speed of the photoconductor drum motor 13 based on the motor current of the intermediate transfer belt motor 15 without fluctuating rapidly the load torque to the intermediate transfer belt motor 15 in a transition from full-color image formation to monochrome image formation.

Figure 11:
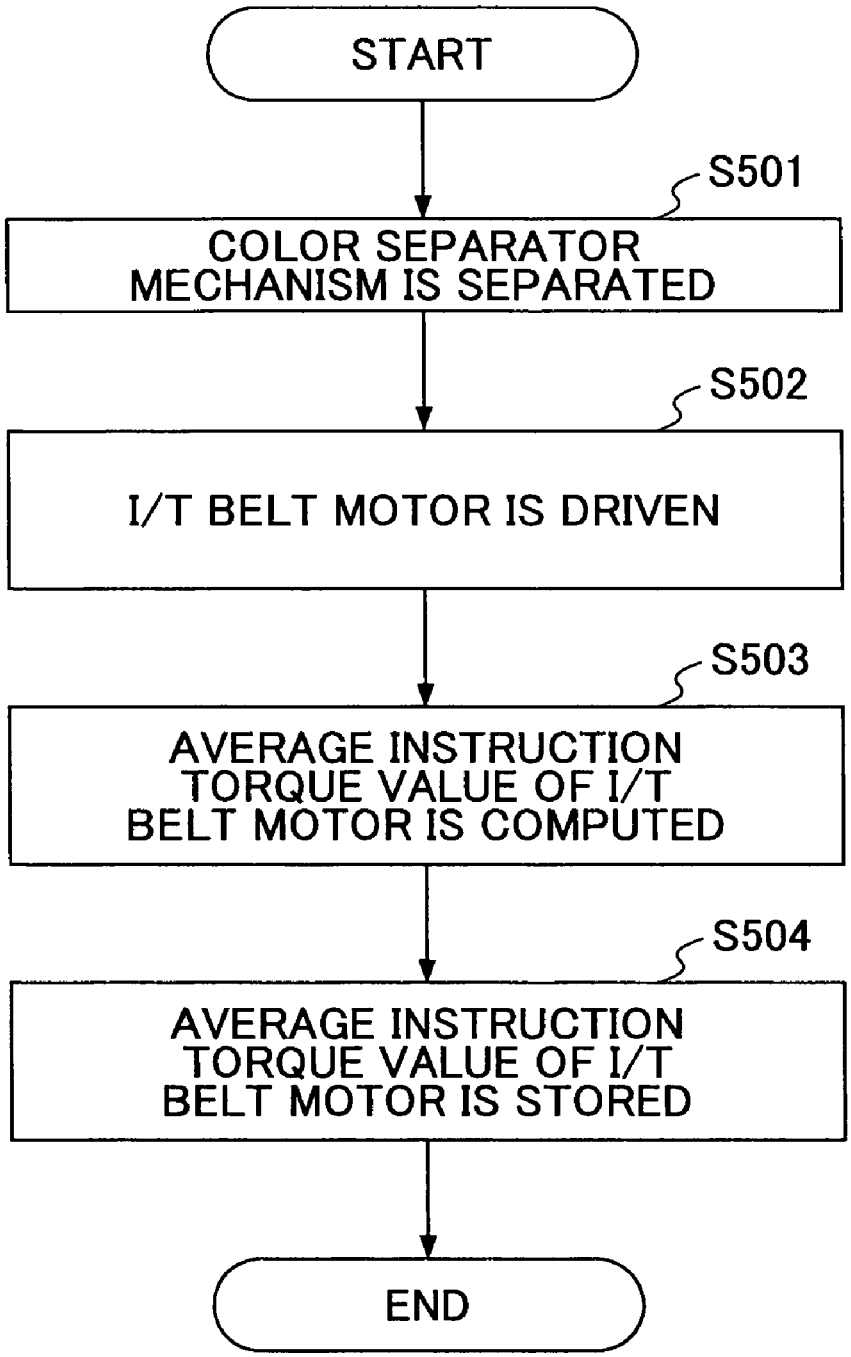
FIG. 11 is a flowchart for explaining a detection procedure which detects beforehand an instruction torque value to the intermediate transfer belt motor, to obtain a target current value of the intermediate transfer belt motor in a transition from full-color image formation to monochrome image formation.

FIG. 11 is a flowchart for explaining a detection procedure which detects beforehand an instruction torque value to the intermediate transfer belt motor, to obtain a target current value of the intermediate transfer belt motor in a transition from full-color image formation to monochrome image formation.

As illustrated in FIG. 11, the main CPU 110 causes the color separator mechanism 4 (separator mechanism 4YMC) to separate the intermediate transfer belt 5 from the color photoconductor drums (step S501), and drives the intermediate transfer belt motor 15 (step S502).

The main CPU 110 computes an average instruction torque value of the intermediate transfer belt motor in step S502 (step S503), and stores the computed average instruction torque value (step S504).

The main CPU 110 uses the average instruction torque value stored in step S504 as a target value of the instruction torque value to the intermediate transfer belt motor 15 in a transition from full-color image formation to monochrome image formation, and uses the stored average instruction torque value in carrying out variable control of the speed of the photoconductor drum motor 13.

The detection procedure of FIG. 11 may be performed at a time the power switch is turned on or a time the temperature inside the image forming device has changed by a certain amount.

Figure 12:
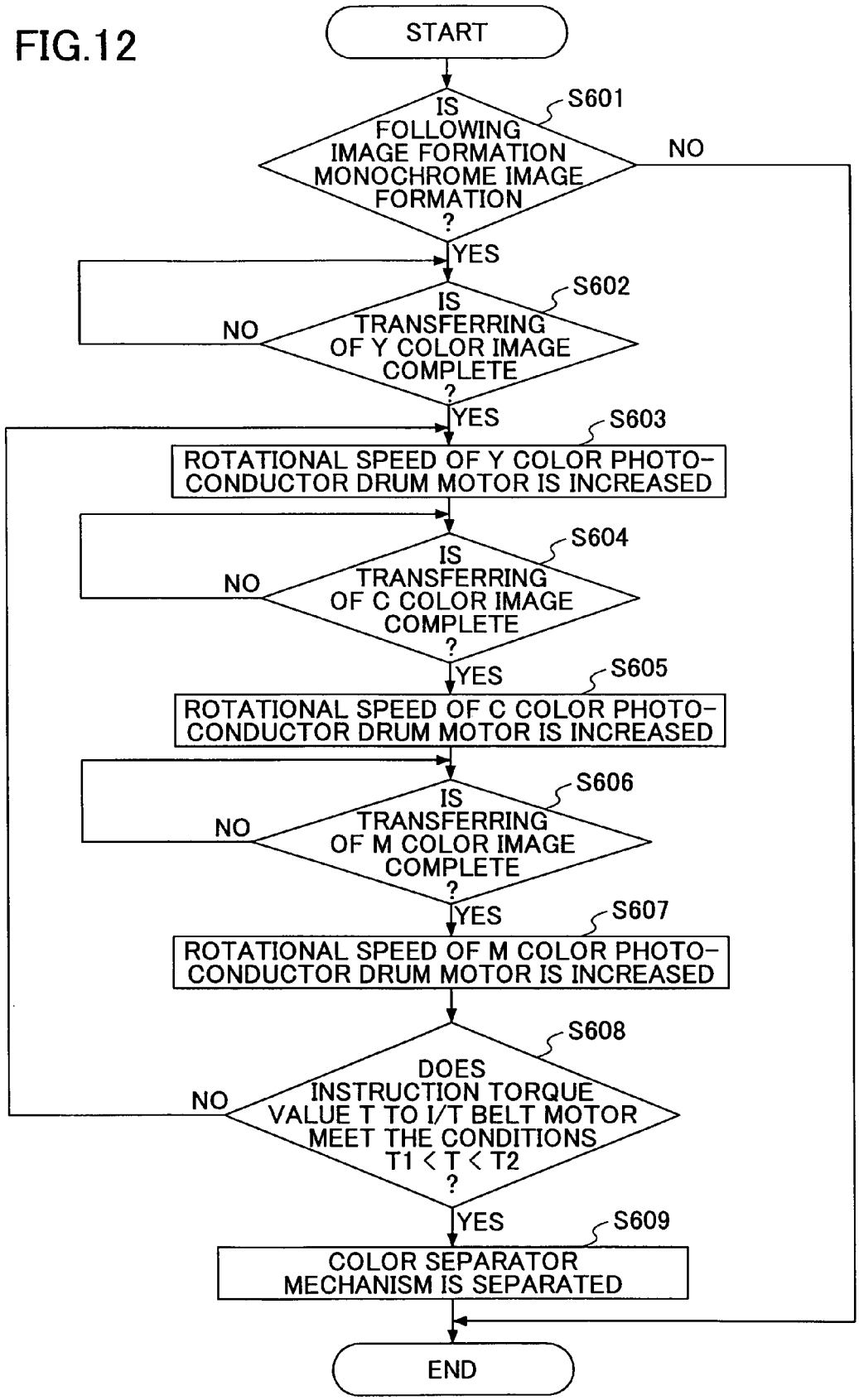
FIG. 12 is a flowchart for explaining a control procedure in which the speeds of the photoconductor drum motors are increased in a transition from full-color image formation to monochrome image formation based on an instruction torque value to the intermediate transfer belt motor at the time of monochrome image formation.

FIG. 12 is a flowchart for explaining a control procedure in which the speed of the photoconductor drum motors are increased in a transition from full-color image formation to monochrome image formation based on the motor instruction torque value to the intermediate transfer belt motor at the time of monochrome image formation.

As illustrated in FIG. 12, if the main CPU 110 detects at the time of full-color image formation that the following image formation is monochrome image formation (step S601), the main CPU 110 detects whether the transferring of a Y color image is complete based on the Y image frame signal of the current image which is used as a trigger to form the Y color image on the photoconductor drum 1Y and transfer the Y color image at the transfer position (step S602). After it is detected in step S602 that the transferring of the Y color image is complete, the main CPU 110 increases the rotational speed of the photoconductor drum motor 13Y by dV (step S603).

Next, the main CPU 110 detects whether the transferring of a C color image is complete based on the C image frame signal of the current image which is used as a trigger to form the C color image on the photoconductor drum 1C and transfer the C color image at the transfer position (step S604). After it is detected in step S604 that the transferring of the C color image is complete (YES in step S604), the main CPU 110 increases the rotational speed of the photoconductor drum motor 13C by dV (step S605).

Next, the main CPU 110 detects whether the transferring of a M color image is complete based on the M image frame signal of the current image which is used as a trigger to form the M color image on the photoconductor drum 1M and transfer the M color image at the transfer position (step S606). After it is detected in step S606 that the transferring of the M color image is complete (YES in step S606), the main CPU 110 increases the rotational speed of the photoconductor drum motor 13M by dV (step S607).

At this time, the main CPU 110 detects whether the instruction torque value T to the intermediate transfer belt motor 15 meets the conditions: T1<T<T2 (step S608). When the instruction torque value T to the intermediate transfer belt motor 15 does not meet the conditions: T1<T<T2 (NO in step S608), the procedure of the steps S603 to S607 is repeated, and the rotational speeds of the photoconductor drum motors 13 of Y, C and M are changed again.

When the conditions T1<T<T2 are met (YES in step S608), the intermediate transfer belt 5 is separated from the photoconductor drum 1 by using the color separator mechanism 4YMC (step S609), the control procedure is terminated. Then, formation of the following monochrome image will be performed.

In the above-described procedure, when the main CPU 110 detects that the following image formation is not monochrome image formation (NO in step S601), the control procedure is terminated.

When it is detected in each of the steps S602, S604 and S606 that the transferring of the image of each color is not complete (NO in steps S602, S604 and S606), the control procedure is continued until the transferring is complete.

The values of T1 and T2 are set up beforehand to designate a range of target voltage value for the instruction torque value T. If the instruction torque value T is in the range between T1 and T2, then it is determined in step S608 that the conditions are met.

When the voltage instruction torque value T is in the range between T1 and T2, it can be considered that the torque to the intermediate transfer belt motor 15 is equal to the torque to the intermediate transfer belt motor 15 at the time of monochrome image formation.

In this embodiment, the values of T1 and T2 may be set to arbitrary values.

In the control procedure of FIG. 12, the speeds of three photoconductor drum motors 13 of Y, C, and M are changed. Alternatively, the control procedure may be replaced by changing the speed of at least one of the photoconductor drum motors 13.

By the control procedure of this embodiment, it is possible to control the speed of a photoconductor drum motor based on the motor instruction torque value to the intermediate transfer belt motor 15 without fluctuating rapidly the load torque to the intermediate transfer belt motor 15 in a transition from full-color image formation to monochrome image formation.

Next, an image forming device of a second embodiment of the invention is adapted for a case in which the surface speed of the photoconductor drum 1 is larger than the surface speed of the intermediate transfer belt 5.

Figure 13:
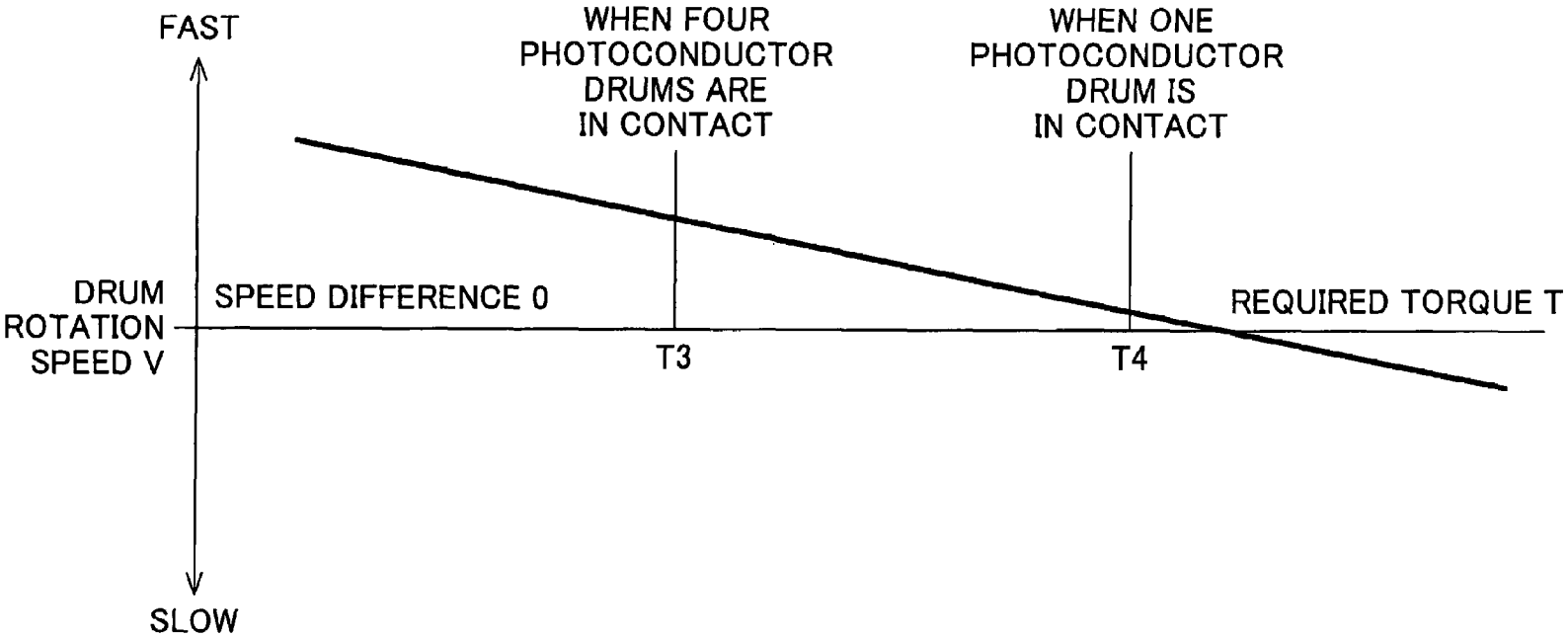
FIG. 13 is a diagram for explaining the relationship between the rotational speed of a photoconductor drum motor and the required torque of an intermediate transfer belt motor when the surface speed of a photoconductor drum is larger than the surface speed of an intermediate transfer belt.

FIG. 13 is a diagram for explaining the relationship between the rotational speed of a photoconductor drum motor and the required torque of an intermediate transfer belt motor when the surface speed of a photoconductor drum is larger than the surface speed of an intermediate transfer belt.

As illustrated in FIG. 13, when the surface speed of the photoconductor drum 1 is larger than the surface speed of the intermediate transfer belt 5, the force of the photoconductor drum 1 works to pull the intermediate transfer belt 5 in the direction of movement of the photoconductor drum 1. The required torque T3 of the intermediate transfer belt motor 15 when the four photoconductor drums 1 are contacted to the intermediate transfer belt 5 is smaller than the required torque T4 of the intermediate transfer belt motor 15 when one photoconductor drum 1 is contacted to the intermediate transfer belt 5.

Hence, the image forming device of the second embodiment is arranged to change the rotational speed of the photoconductor drum motor 13 in order to eliminate the load fluctuation in a transition from the time of the four photoconductor drums 1 contacting the intermediate transfer belt 5 to the time of one photoconductor drum 1 contacting the intermediate transfer belt 5 or vice versa.

In the second embodiment, the circumferential speeds (rotational speeds) of the color photoconductor drums 1Y, 1C and 1M are changed in a transition from full-color image formation to monochrome image formation, in order to smoothly change the required torque T3 of the intermediate transfer belt motor 15 when the four photoconductor drums 1Y, 1C, 1M and 1B contact the intermediate transfer belt 5 to form a full-color image to the required torque T4 when only the photoconductor drum 1B contacts the intermediate transfer belt 5 to form a monochrome image.

Specifically, in a case of the surface speed of the photoconductor drum 1 being larger than the surface speed of the intermediate transfer belt 5, the rotational speeds of the color photoconductor drums 1Y, 1C and 1M are decreased in a transition from the full-color image formation mode to the monochrome image formation mode to make the required torque of the intermediate transfer belt motor 15 to drive the intermediate transfer belt 5 equal to the required torque T4 of the intermediate transfer belt motor 15 in the monochrome image formation mode.

In other words, the surface speeds of the color photoconductor drums 1Y, 1C and 1M are changed so as to approach the surface speed of the intermediate transfer belt 5 at the time of monochrome image formation. Thereby, the required torque of the intermediate transfer belt motor 15 to drive the intermediate transfer belt 5 at a start of monochrome image formation can approach the required torque T4 of the intermediate transfer belt motor 15 when only the photoconductor drum 1B contacts the intermediate transfer belt 5 (which is similar to that described in the first embodiment).

Figure 14:
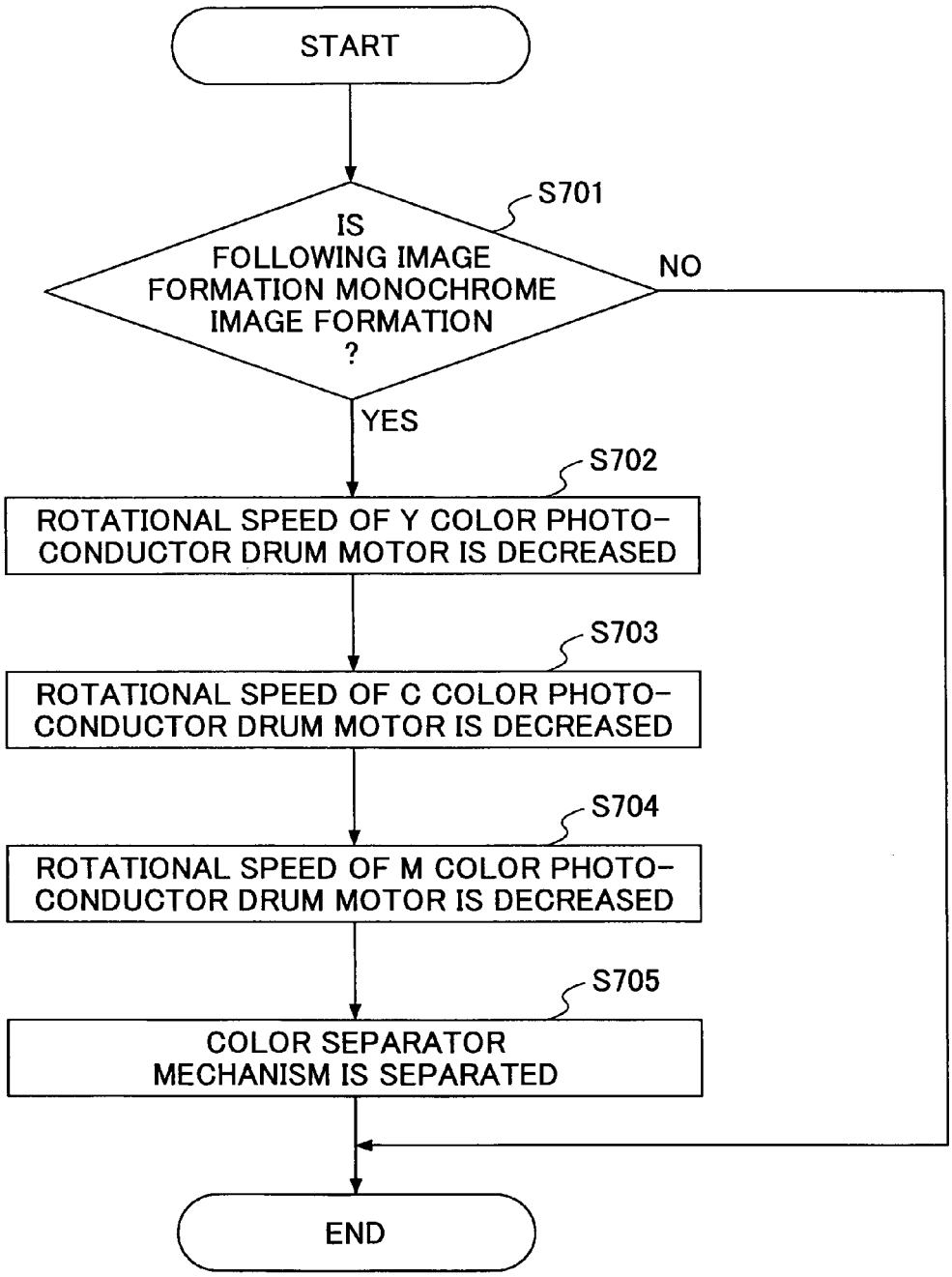
FIG. 14 is a flowchart for explaining a control procedure in a transition from full-color image formation to monochrome image formation when the surface speed of a photoconductor drum is larger than the surface speed of an intermediate transfer belt.

FIG. 14 is a flowchart for explaining a control procedure in a transition from full-color image formation to monochrome image formation when the surface speed of a photoconductor drum is larger than the surface speed of an intermediate transfer belt.

As illustrated in FIG. 14, in steps S702-S704, the rotational speeds of the photoconductor drums 1 are decreased. Except these steps, the control procedure of FIG. 14 is the same as the control procedure of FIG. 6, and a description thereof will be omitted.

The manner the rotational speeds of the photoconductor drums 1 are decreased in the control procedure of FIG. 14 is the same as that as illustrated in the timing chart of FIG. 7. One of the speeds of the drum motors 13 of the respective colors is sequentially decreased by dV each time the time td has elapsed. The rotational speeds of the photoconductor drum motors 13 are changed so that the required torque T3 of the intermediate transfer belt motor 15 when the four photoconductor drums 1 are in contact to form a full-color image is smoothly changed to the required torque T4 of the intermediate transfer belt motor 15 when only the photoconductor drum 1B is in contact to form a monochrome image. Thereby, it is possible to change gently the load fluctuation at the time of the transition.

Figure 15:
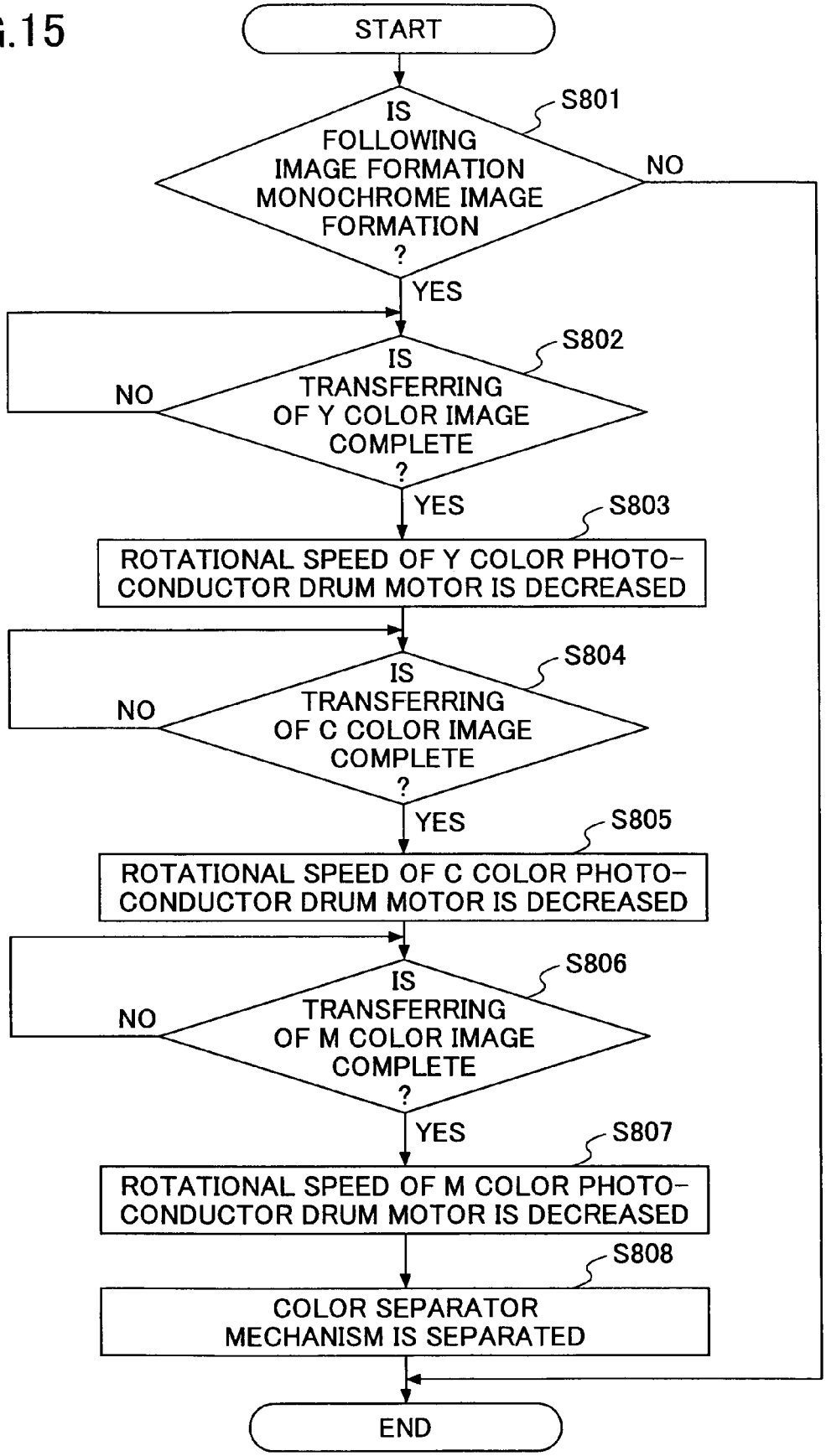
FIG. 15 is a flowchart for explaining a control procedure in which the rotational speeds of the photoconductor drum motors are decreased sequentially from that of the photoconductor drum in which the transferring of an image is completed.

FIG. 15 is a flowchart illustrates a control procedure in which the rotational speeds of the photoconductor drum motors are decreased sequentially from that of the photoconductor drum in which the transferring of an image is completed.

As illustrated in FIG. 15, in steps S803, S805 and S807, the rotational speeds of the photoconductor drums 1 are decreased. Except these steps, the control procedure of FIG. 15 is the same as the control procedure of FIG. 8, and a description thereof will be omitted.

Figure 16:
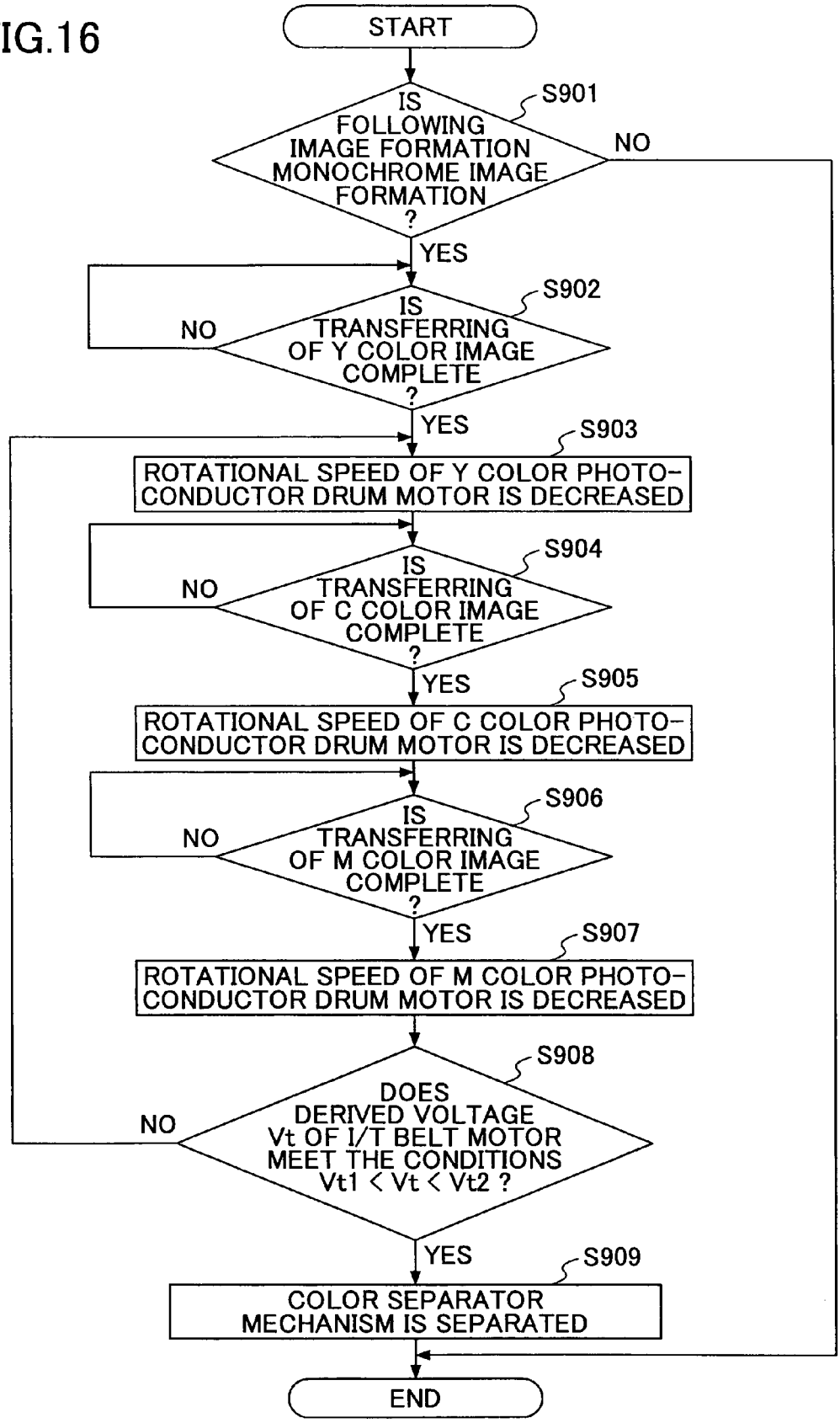
FIG. 16 is a flowchart for explaining a control procedure in which the speeds of the photoconductor drum motors are decreased based on a motor current value of the intermediate transfer belt motor at the time of monochrome image formation.

FIG. 16 is a flowchart for a control procedure in which the speeds of the photoconductor drum motors are decreased based on a motor current value of the intermediate transfer belt motor at the time of monochrome image formation.

As illustrated in FIG. 16, in steps S903, S905 and S907, the control of decreasing the rotational speeds of the photoconductor drums 1 is carried out by using as a target current value the detected motor current value of the intermediate transfer belt motor which is detected beforehand at the time of monochrome image formation. Except these steps, the control procedure of FIG. 16 is the same as the control procedure of FIG. 10, and a description thereof will be omitted.

Figure 17:
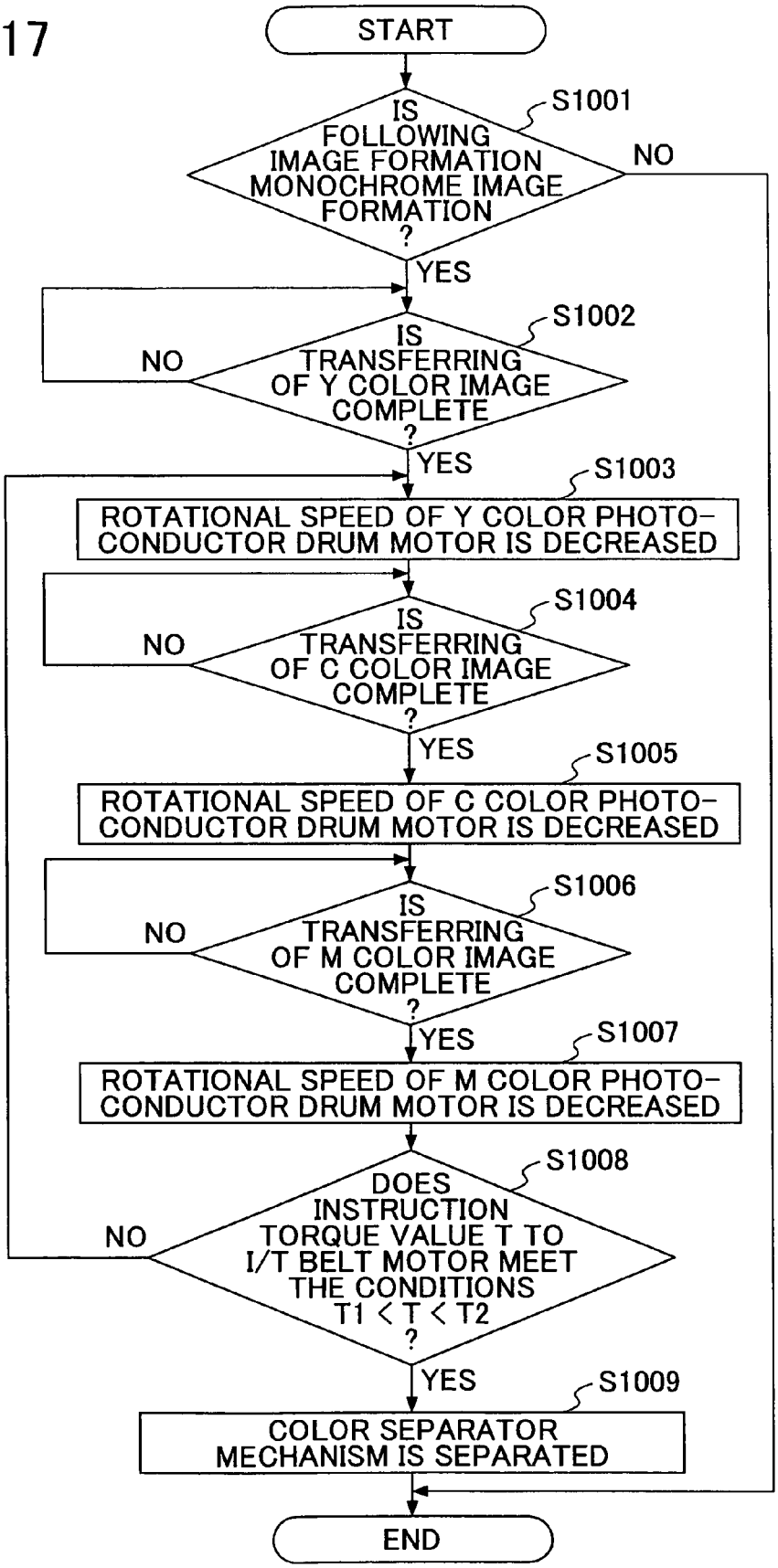
FIG. 17 is a flowchart for explaining a control procedure in which the speeds of the photoconductor drum motors are decreased based on an instruction torque value to the intermediate transfer belt motor at the time of monochrome image formation.

FIG. 17 is a flowchart for explaining a control procedure in which the speeds of the photoconductor drum motors are decreased based on an instruction torque value to the intermediate transfer belt motor at the time of monochrome image formation.

As illustrated in FIG. 17, in steps S1003, S1005 and S1007, the control of decreasing the speeds of the photoconductor drum motors is carried out based on the instruction torque value to the intermediate transfer belt motor which is detected beforehand. Except these steps, the control procedure of FIG. 17 is the same as the control procedure of FIG. 12, and a description thereof will be omitted.

The method of detecting the current value or the instruction torque value at the time of the monochrome image formation which is used for the control procedure of FIG. 16 or FIG. 17 is the same as that in the first embodiment.

Figure 18:
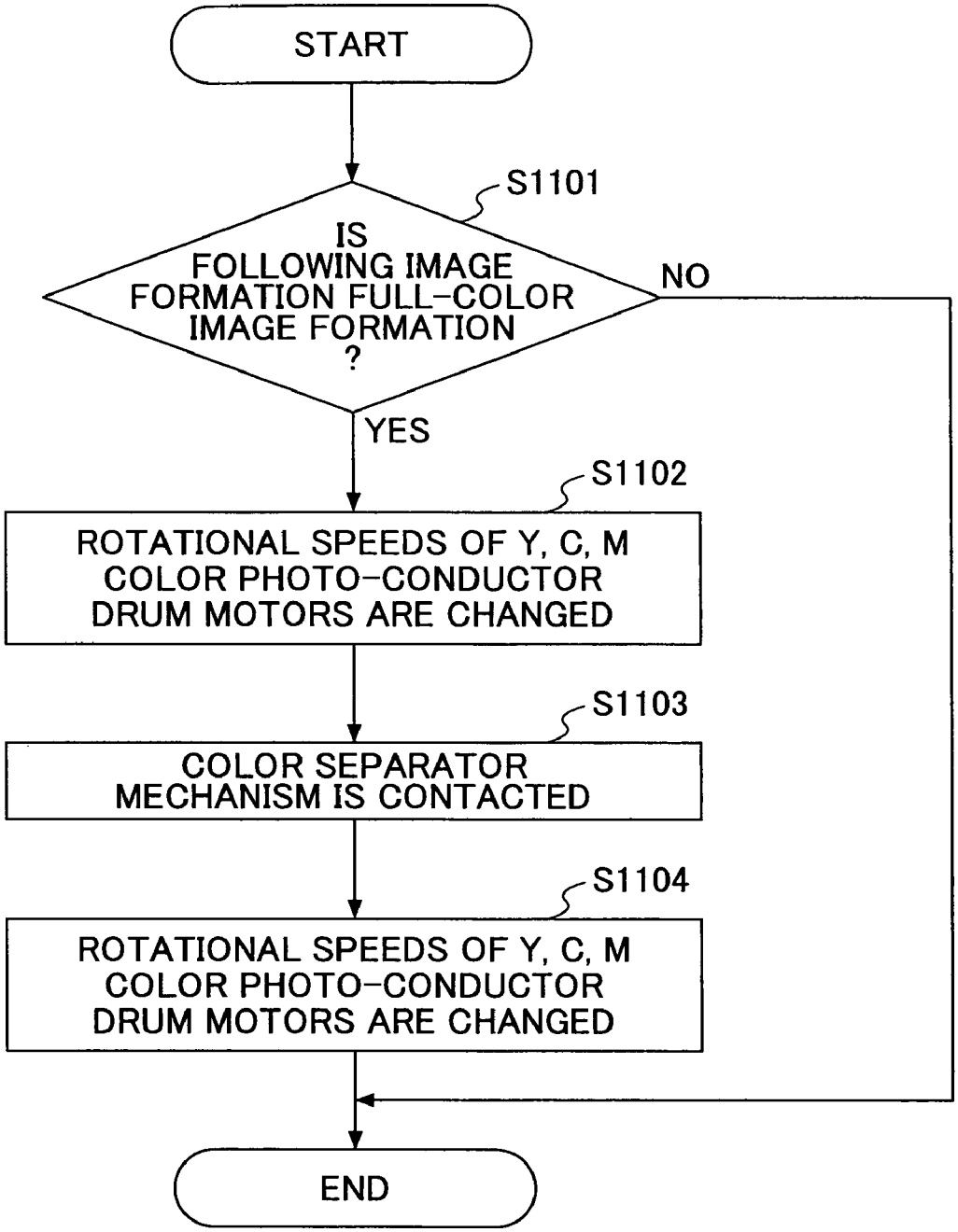
FIG. 18 is a flowchart for explaining a control procedure in a transition from monochrome image formation to full-color image formation when the surface speed of a photoconductor drum is smaller than the surface speed of an intermediate transfer belt.
Figure 19:
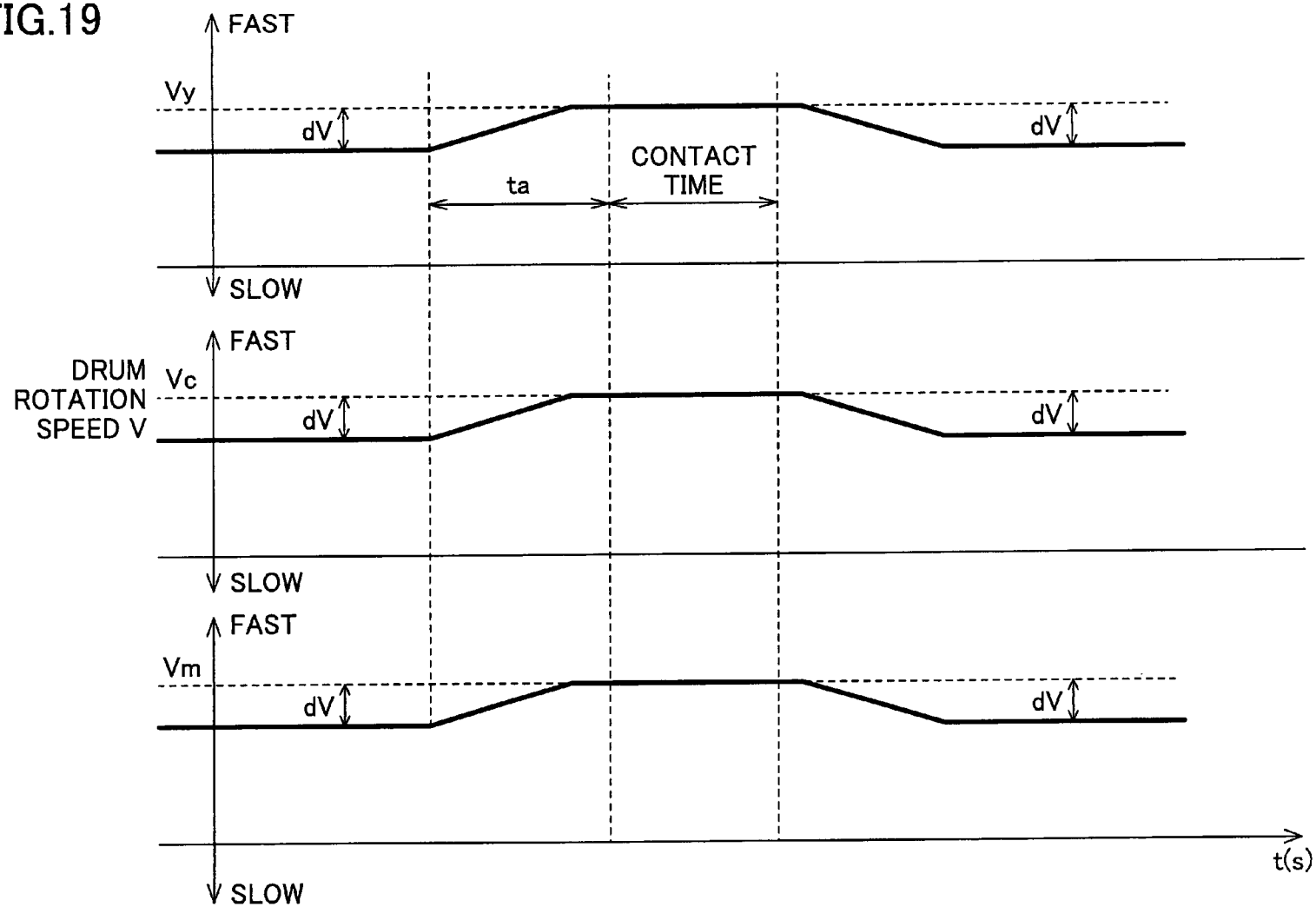
FIG. 19 is a timing chart for explaining the control timing in the control procedure of FIG. 18.

FIG. 18 is a flowchart for explaining a control procedure in a transition from monochrome image formation to full-color image formation when the surface speed of a photoconductor drum is smaller than the surface speed of an intermediate transfer belt. FIG. 19 is a timing chart for explaining the control timing in the control procedure of FIG. 18.

As illustrated in FIG. 18, when it is detected by the main CPU 110 at the time of monochrome image formation that the following image formation is full-color image formation (step S1101), the rotational speeds of the photoconductor drum motors 13Y, 13C and 13M of Y, C and M are respectively increased by dV (step S1102).

At this time, the photoconductor drums 1Y, 1C and 1M are separated from the intermediate transfer belt 5. For example, when a given time ta has elapsed (refer to FIG. 19) in increasing the speeds of the photoconductor drum motors in the above step S1102, the color separator mechanism 4 is driven to contact the intermediate transfer belt 5, so that the photoconductor drum 1 and the intermediate transfer belt 5 are contacted together (step S1103).

Then, the rotational speed of the photoconductor drum motors 13Y, 13C and 13M of Y, C and M are returned to the original setting speed (step S1104).

In the procedure of FIG. 18, when it is detected by the main CPU 110 that the following image formation is not full-color image formation (NO in step S1101), the control procedure is terminated.

When the rotational speed of the photoconductor drum motor 13 is returned to the original setting speed, the motor speed may be gradually changed in a number of steps as previously described.

In the control procedure of FIG. 18, the speeds of the three photoconductor drum motors 13Y, 13C and 13M of Y, C and M are changed. Alternatively, only the speed of at least one of the photoconductor drum motors 13 may be changed.

Figure 20:
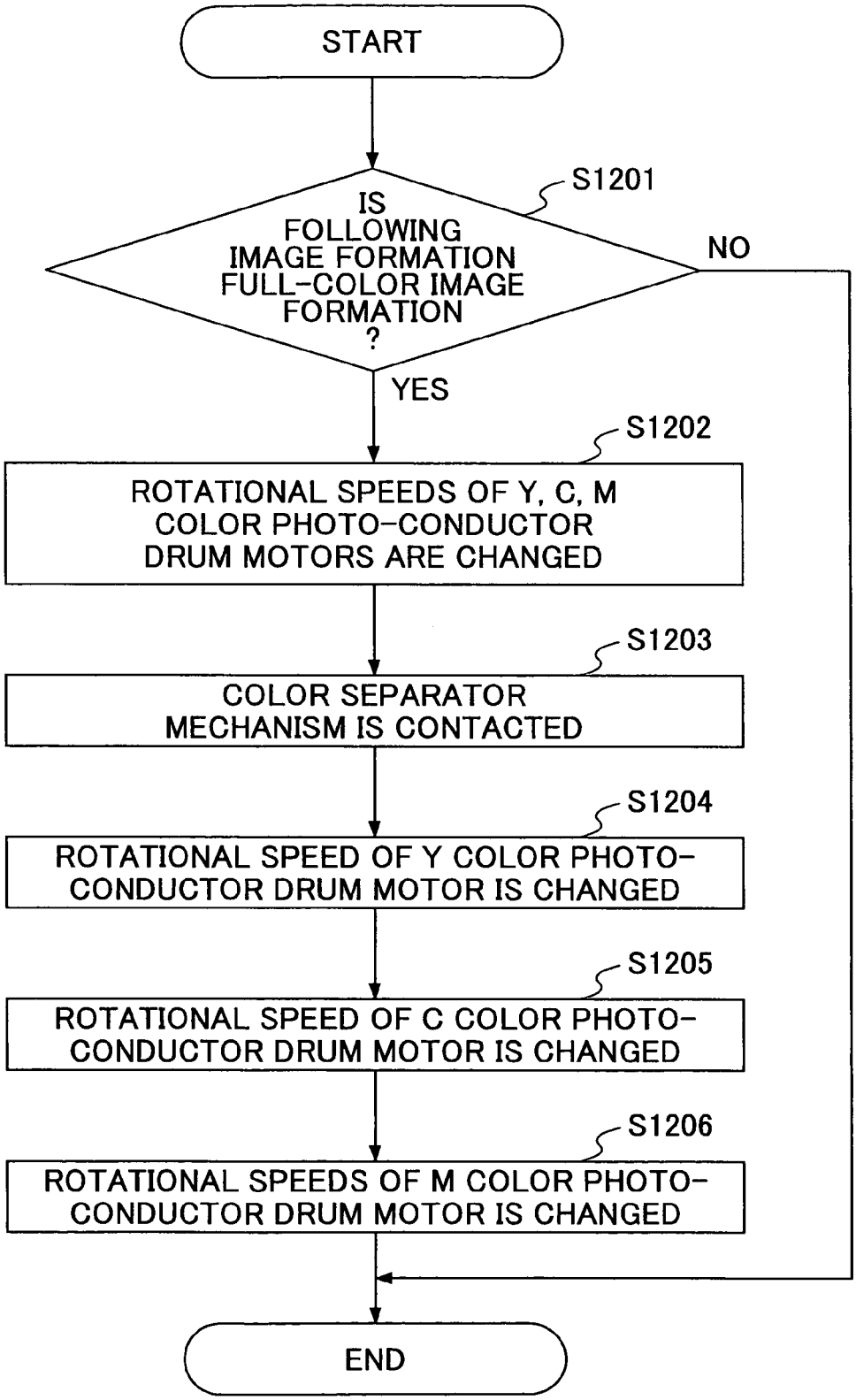
FIG. 20 is a flowchart for explaining a control procedure in which the speeds of the photoconductor drum motors are returned to the original speeds in a transition from monochrome image formation to full-color image formation sequentially from an upstream side one of the photoconductor drums in a direction of movement of the intermediate transfer belt.
Figure 21:
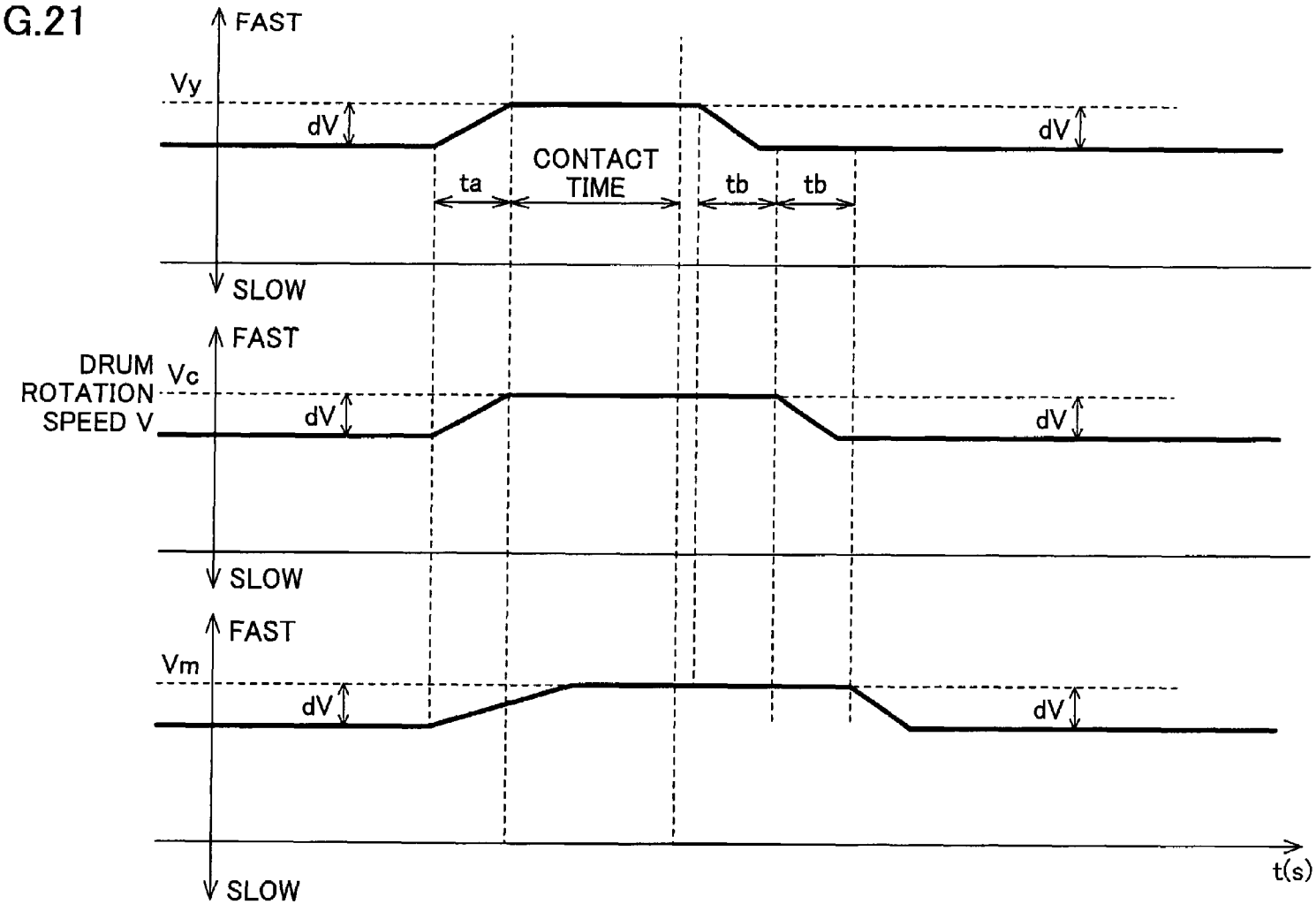
FIG. 21 is a timing chart for explaining the control timing in the control procedure of FIG. 20.

FIG. 20 is a flowchart for explaining a control procedure in which the speeds of the photoconductor drum motors are returned to the original speeds in a transition from monochrome image formation to full-color image formation sequentially from an upstream one of the photoconductor drums in a direction of movement of the intermediate transfer belt. FIG. 21 is a timing chart for explaining the control timing in the control procedure of FIG. 20.

In FIG. 21, the horizontal axis denotes the elapsed time t(s), and the vertical axis denotes the respective speeds Vy, Vc and Vm of the photoconductor drum motors 13 of Y, C and M.

As illustrated in FIG. 20, when it is detected by the main CPU 110 at the time of monochrome image formation that the following image formation is full-color image formation (step S1201), the rotational speeds of the photoconductor drum motors 13Y, 13C and 13M of Y, C and M are increased by dV respectively (step S1202).

After a given time ta has elapsed from the time the speeds are changed in the step S1202 (refer to FIG. 21), the color separator mechanism 4 is driven to contact the intermediate transfer belt 5 so that the photoconductor drum and the intermediate transfer belt are contacted (step S1203).

Then, the rotational speed of the photoconductor drum motor 13Y of Y color is returned to the original setting speed (step S1204). After a given time tb has elapsed, the rotational speed of the photoconductor drum motor 13C of C color is returned to the original setting speed (step S1205), and after the given time tb has further elapsed, the rotational speed of the photoconductor drum motor 13M of M color is returned to the original setting speed (step S1206).

In the control procedure of FIG. 20, when it is detected by the main CPU 110 that the following image formation is not full-color image formation (NO in step S1201), the control procedure is terminated.

When the rotational speed of the photoconductor drum motor 13 is returned to the original setting speed, the motor speed may be gradually changed in a number of steps as previously described.

In performing the following image formation, the formation of an image may be started immediately after returning the speed of the photoconductor drum motor 13 is returned to the original setting speed.

In the above-described embodiments:

1) The rotational speeds of the color photoconductor drum motors 13Y, 13C and 13M are changed gently in a transition from full-color image formation to monochrome image formation or vice versa, to make the required torque of the intermediate transfer belt motor 15 equal to the required torque of the intermediate transfer belt motor 15 corresponding to each image formation mode, and the surface speeds of the color photoconductor drums 1 are brought close to the surface speed of the intermediate transfer belt 5.

Because the dynamic friction resistance between the intermediate transfer belt 5 and the photoconductor drums 1Y, 1C and 1M can be changed, gently, the intermediate transfer belt motor 15 will not receive a rapid load fluctuation, and it is possible to prevent the deterioration of a reproduced image in a transition from full-color image formation to monochrome image formation or vice versa.

2) Because the instruction torque value to the intermediate transfer belt motor 15 is monitored and the rotational speed of the photoconductor drum motor 13 is adjusted based on the monitoring result, the load on the intermediate transfer belt motor can be controlled with sufficient accuracy.

3) Because the motor current of the intermediate transfer belt motor 15 is monitored and the rotational speed of the photoconductor drum motor 13 is adjusted based on the result of the monitoring, the load on the intermediate transfer belt motor can be controlled with sufficient accuracy.

4) Because the state of image formation state is monitored by using an image frame signal and the state in which an image does not appear on the photoconductor drum 1 can be checked, the speed of the photoconductor drum motor can be changed without arranging a special sensor.

5) Because the speeds of the photoconductor drum motors 13 are changed sequentially from that of the photoconductor drum in which image formation is completed and the load on the intermediate transfer belt motor 15 during full-color image formation is controlled, the inoperable time can be avoided. Hence, it is possible to improve the productivity.

In the foregoing embodiments, the indirect transfer tandem type image forming device has mainly been described. Alternatively, the invention may be applied to the direct transfer tandem type image forming device as well. In the case of the direct transfer tandem type image forming device, the transfer transport belt 30 corresponds to the intermediate transfer belt 5, and the transport belt motor 31 corresponds to the intermediate transfer belt motor 15.

Moreover, the relation of the driving control of the transport belt motor 31 and the driving control of the photoconductor drum motors 14Y, 14C, 14M and 14B in the direct transfer tandem type image forming device is the same as the relation of the driving control of the intermediate transfer belt motor 15 and the driving control of the photoconductor drum motors 13Y, 13C, 13M and 13B in the indirect transfer tandem type image forming device.

As described in the foregoing, the image forming device according to the embodiments of the invention prevents rapid fluctuation of the load torque to the intermediate transfer belt motor or the transfer transport belt motor arising in a transition from the full-color image formation mode to the monochrome image formation mode or vice versa, thereby avoiding deterioration of a reproduced image.

The present invention is not limited to the specifically disclosed embodiments, and variations and modifications may be made without departing from the scope of the present invention.

The present application is based on Japanese patent application No. 2008-163542, filed on Jun. 23, 2008, and Japanese patent application No. 2009-137714, filed on Jun. 8, 2009, the contents of which are incorporated herein by reference in their entirety.

What is claimed is:

1. An image forming device provided with a full-color image formation mode to form a color image using a plurality of color photoconductor drums and a monochrome image formation mode to form a monochrome image using a single photoconductor drum, the image forming device comprising:

a driving unit to drive rotation of an intermediate transfer belt or a transfer transport belt;

a control unit to change rotational speeds of the plurality of color photoconductor drums in a transition from the full-color image formation mode to the monochrome image formation mode to make a torque to the driving unit in the full-color image formation mode equal to a torque to the driving unit in the monochrome image formation mode; and a separator unit to separate the plurality of color photoconductor drums from the intermediate transfer belt or the transfer transport belt after the rotational speeds of the plurality of color photoconductor drums are changed by the control unit.

2. The image forming device according to claim 1, wherein the control unit is configured to increase a rotational speed of at least one of the plurality of color photoconductor drums.

3. The image forming device according to claim 1, further comprising an instruction torque value detecting unit to detect a value of an instruction torque to the driving unit, and the control unit is configured to change the rotational speed of the plurality of color photoconductor drums based on the value of the instruction torque detected by the instruction torque value detecting unit.

4. The image forming device according to claim 1, wherein the control unit includes a current detecting unit to detect a current which passes through the driving unit, and the control unit is configured to change the rotational speed of the plurality of color photoconductor drums based on the current detected by the current detecting unit.

5. The image forming device according to claim 1, wherein the control unit is configured to change a rotational speed of the plurality of color photoconductor drums by using an image region signal of each of respective colors as a trigger.

6. The image forming device according to claim 1, wherein the control unit is configured to change respective rotational speeds of the plurality of color photoconductor drums sequentially from an upstream side one of the plurality of color photoconductor drums in a direction of belt movement.

7. The image forming device according to claim 1, wherein one or more images formed on the intermediate transfer belt by one or more of the plurality of color photoconductor drums and the single photoconductor drum are transferred to an image printing medium.

8. The image forming device according to claim 1, wherein an image printing medium is attracted and transported by the transfer transport belt and one or more images from one or more of the plurality of color photoconductor drums and the single photoconductor drum are transferred to the image printing medium.

9. A photoconductor drum drive controlling method for an image forming device provided with a full-color image formation mode to form a color image using a plurality of color photoconductor drums and a monochrome image formation mode to form a monochrome image using a single photoconductor drum, the image forming device including a driving unit to drive rotation of an intermediate transfer belt or a transfer transport belt, the photoconductor drum drive controlling method comprising:

changing, by a control unit of the image forming device, rotational speeds of the plurality of color photoconductor drums in a transition from the full-color image formation mode to the monochrome image formation mode to make a torque to the driving unit in the full-color image formation mode equal to a torque to the driving unit in the monochrome image formation mode; and separating, by a separator unit of the image forming device, the plurality of color photoconductor drums from the intermediate transfer belt or the transfer transport belt after the rotational speeds of the plurality of color photoconductor drums are changed by the control unit.

10. A non-transitory computer-readable recording medium storing a photoconductor drum drive controlling program which, when executed by a computer, causes the computer to perform the photoconductor drum drive controlling method according to claim 9.

* * * * *